US006705234B1

(12) United States Patent
Miller et al.

(10) Patent No.: US 6,705,234 B1
(45) Date of Patent: Mar. 16, 2004

(54) FOLDING TABLE

(76) Inventors: Kurt Miller, 1811 Olive Ave., Richmond, CA (US) 94805; David Kumarich, 1991 NW. Upshur St. -Ste E, Portland, OR (US) 97209

( * ) Notice: Subject to any disclaimer, the term of this patent is extended or adjusted under 35 U.S.C. 154(b) by 0 days.

(21) Appl. No.: 09/709,032

(22) Filed: Nov. 8, 2000

(51) Int. Cl.[7] ..... A47B 3/00
(52) U.S. Cl. ..... 108/36; 108/169; 108/115
(58) Field of Search ..... 108/34, 35, 36, 108/38, 115, 132, 130, 131, 129, 169; 16/221, 242, 254, 361, 362

(56) References Cited

U.S. PATENT DOCUMENTS

| | | | | |
|---|---|---|---|---|
| 643,511 | A | * | 2/1900 | Lloyd |
| 1,063,642 | A | * | 6/1913 | Birdsall |
| 1,103,532 | A | * | 7/1914 | Nielsen |
| 1,108,326 | A | | 8/1914 | Brown et al. |
| 1,109,406 | A | | 9/1914 | Dolge |
| 1,434,100 | A | | 10/1922 | Creasy |
| 1,530,719 | A | | 3/1925 | Harris |
| 1,696,193 | A | | 12/1928 | Deland |
| 1,990,600 | A | | 2/1935 | Fridheim |
| D159,688 | S | | 8/1950 | Socol |
| 2,517,681 | A | | 8/1950 | Koerper |
| 2,533,787 | A | * | 12/1950 | Gebhart |
| 2,799,867 | A | | 7/1957 | Fenner et al. |
| 3,359,576 | A | | 12/1967 | Pile |
| 4,333,638 | A | | 6/1982 | Gillotti |
| 4,630,550 | A | * | 12/1986 | Weitzman ..... 108/180 X |
| 4,800,678 | A | * | 1/1989 | Loos ..... 16/61 X |
| 4,833,998 | A | | 5/1989 | Everett et al. |
| 4,927,128 | A | | 5/1990 | O'Brian |
| 4,943,041 | A | * | 7/1990 | Romein ..... 108/36 X |
| 5,009,170 | A | | 4/1991 | Spehar |
| 5,216,769 | A | | 6/1993 | Eakin |
| 5,335,676 | A | | 8/1994 | O'Brien |
| D352,635 | S | | 11/1994 | Yoder |
| 5,500,985 | A | * | 3/1996 | Klueger ..... 16/361 X |
| 5,784,732 | A | * | 7/1998 | Vail ..... 16/361 X |
| 5,943,965 | A | * | 8/1999 | Riach et al. ..... 108/36 |
| 5,946,774 | A | * | 9/1999 | Ramsey et al. ..... 16/361 X |
| 5,947,037 | A | * | 9/1999 | Hornberger et al. ..... 108/115 |
| 6,000,345 | A | * | 12/1999 | Gillotti ..... 108/36 |
| 6,076,472 | A | * | 6/2000 | Lloyd ..... 108/36 |

FOREIGN PATENT DOCUMENTS

| | | |
|---|---|---|
| FR | 1074106 | 10/1954 |

* cited by examiner

*Primary Examiner*—Jose V. Chen
(74) *Attorney, Agent, or Firm*—Olson & Hierl, Ltd.

(57) ABSTRACT

A folding table is provided having a three-sectioned platform. The table includes two pairs of pivotal supporting legs wherein pair member legs are rigidly cross braced and are held by cable braces when the leg pairs are erected. The table also includes two tensionable platform cable members and a pair of platform-to-cable load transfer bars. When the table is fully erected the platform cable members are tensioned by the load transfer bars and maintain the platform in a flat, load-bearing state. The platform's three sections are interconnected by hinges that permit in a folded table a pair of opposite end sections to overfold one another and overlie an intervening mid-section. When folded, the table has a compact, easily transported configuration with all movable and loose components being internally stored.

22 Claims, 22 Drawing Sheets

FOLDING TABLE

FIELD OF THE INVENTION

This invention relates to an improved folding table of the type having three adjacent and successive hinged sections that in a table assembled configuration form a flat rigidified working platform which is supported by tensioned cable members.

BACKGROUND

Foldable tables and beds adapted for supporting a prone man are known. Such tables have use for massage and medical purposes and such beds (or cots) have use as transient rest platforms. Such structures have a platform means comprised of two or three sections that are interconnected together by hinges. Previously, cable or chain arrangements, sometimes in combination with spar arrangements, have sometimes been used to provide assembled platform section support; see, for example: Pile 3,359,576; Everett et al. 4,833,998; Romein 4,943,041; O'Brien 4,927,128 and Creasy 1,434,100.

These prior art folding table and bed structures all suffer from various common disadvantages. For one thing, the folded configuration of such a table is typically bulky, cumbersome to move or transport, and subject to damage or loss of components. For instance, in a folding table having a two-section platform that is long enough to support a prone man, each section is at least three feet in length when folded, and the folded table typically has exposed or even protruding components. For another thing, such a folding table is also relatively time consuming and laborious to assemble and disassemble, such a procedure commonly requiring tools, physical strength and perhaps more than one person.

Folding tables incorporating two-sections in the platform characteristically cannot be simply converted into tables incorporating three sections in the platform. The desirable objectives of reducing folded table bulk and weight, and of increasing portability and transportability, are not easily achieved in a folding table three-section platform structure. A folding table having three sections in its platform presents a whole group of different component and structural problems which are not present in a two-section table.

A folding table is needed that has a three-section folding platform which is supportable perhaps one meter above ground level and which has a length and strength when assembled sufficient for supporting a prone person of at least about two meters in height and at least 80 kilograms in weight. That table needs to be compact, self-contained and light in weight when folded. Such a table would be desirable for many use situations, particularly in massage and medical treatment, but such a table should additionally have when folded its moving components at least partially concealed or enclosed by the folded sections themselves, and the folded table should be easily transported by one person. Also, such a table should be easily assembled and disassembled by one person, and, when assembled, should be substantially rigid. Further, such a table should be of durable construction, and adapted for undergoing an indefinitely large number of conversions from a full storage configuration to a fully assembled configuration. Such a table should preferably be capable of minor adjustments under field conditions to meet different realistic operational situations. So far as now known, such a folding table that meets such criteria has not heretofore been achieved.

The present invention not only achieves a three-section folding table having such criteria, but also provides such table with additional features and advantages.

SUMMARY OF THE INVENTION

This invention relates to a new and very useful folding table that incorporates a hinged, three-sectioned working platform in combination with two pairs of supporting legs for supporting the platform in its erected configuration. Each leg pair has a rigidifying leg pair cross brace. The table incorporates a plurality of tensionable cable members both for supporting the platform in its erected configuration and for bracing the legs in their respective erected configurations, and also a pair of erected platform-to-cable load transfer bars.

This invention also related to new and improved structures for the platform sections of multi-sectioned table platforms and the like.

The invention further relates to laterally extendable hinge structures that are useful for interconnecting together adjacent folding platform sections and the like.

The platform sections in the invention table are hinged together so as to be successive and contiguous whereby a middle section is joined on each opposite side thereof to a side of a different one end section. When the table is assembled and erected from a folded configuration, the platform is substantially flat. The platform can have various perimeter configurations, depending upon section sizes, but a present preference is for the platform to have when unfolded and erected a quadrilateral, more preferably a rectangular quadrilateral, perimeter that is sized for the support of a prone man, for example, a man having the size and weight values above-indicated. The two opposite end sections are preferably beveled (that is, rounded) along the perimeter of each of their respective exposed outside two corners. Preferably, the sections are hinged together so as to permit the opposite end sections to be each folded inwardly relative to the middle section and away from the erected platform surface through approximately 180° with one section when folded overlying the next adjacent section.

Preferably, the three platform sections have similar but somewhat different individual measurements. Breadth measurements of the respective sections, for example, may be varied for specific purposes in a given table embodiment. Thus, when the inventive table is folded, the three folded platform sections have adjacent faces and the section edges along at least one platform side coact to provide a single, generally flat face that may be placed on a floor surface in the same general manner as a briefcase bottom. Preferably handle carrying means are associated with a top face of the folded platform sections, the top face being opposite the floor-engaging face.

Each of the opposite end sections is connected to the center section by hinge means. Conventional hinge structures may be used. However, the hinge means employed between the center section and one end section is preferably adapted to provide a pivot region that is effectively spaced below the bottom of platform so as to achieve a separation of these sections in the folded platform configuration. In an illustrative but presently preferred embodiment of the present invention, a second one of the two opposite end sections is so connected by hinge means to the center section that the second end section is adapted to overlie the first end section in parallel, adjacent relationship after each of the first and the second end sections have been folded through 180° so to rest adjacent to back side of the middle section in overlying relationship.

The presently preferred table structure preferably provides this section separation when in the folded configuration with no hinge elements extending below about the bottom edge of the platform surface when the platform is in the unfolded position. This preferred structure enables the inventive table platform to be used, if desired, as a mat on a flat surface with the sections unfolded, but with the legs and support structures remaining folded beneath and preferably within the bodies of the panel sections.

A first end section can utilize a conventional type of first hinge structure for foldable connection to the center section. The second end section can employ various second hinge structures, but such a second hinge structure should be laterally extendable. Thus, such a preferred second hinge structure incorporates a hinge, leaf member pair wherein one respective end portion of each leaf member is engaged with the other by, interdigitated knuckle members and wherein each hinge leaf member is laterally extendable relative to, and when extended is spaced from, the other. Preferably, this second hinge structure for the second end section includes a hinge link structure to which each leaf member is pivotably joined by a pintle means so that each leaf member of the pair is selectively slidably laterally extendable relative to the other yet remains pivotable relative to the pintle means. Thus, with such a hinge structure, each leaf member can be connected to a different one of two adjoining sections (here, the middle section and the second end section). In the platform erected (i.e., open or flat) configuration, the sides of these adjoining platform sections are in adjacent relationship with the individual leaf members having adjacently oriented faces; but, in the platform folded configuration, these adjoining sections and their associated hinge leaf members are in spaced, adjacent relationship. The spacing between the leaf members in this folded configuration is sufficient to accommodate the thickness of the previously folded first end section whereby the folded second end section can overlie the folded first end section. The present invention provides an illustrative but presently preferred embodiment of such laterally extendable hinge structure.

Each pair of the supporting legs is preferably longitudinally and symmetrically spaced from the other with each pair being associated with a different one of the two end sections. Each pair has its individual leg members interconnected together, preferably in a midregion thereof, by a different one rigidifying cross brace. Preferably, the upper end of each leg member is pivotally associated with a portion of the underside of a different one of the end sections. Preferably, each individual leg is so pivotally joined to an end section outside corner region. Preferably, each leg is similarly constructed and comprised of telescopically interconnecting elongated tubular sections, most preferably comprising two such sections.

Each leg, preferably in a mid-region thereof, is preferably directly or indirectly associated with an end region of each one of two different cable members. A first such cable member extends upwardly and diagonally to an adjacent longitudinal side portion of the associated end section and is connected thereto. The second such cable member extends upwardly and somewhat diagonally to an adjacent outside end portion of the associated end section and is connected thereto. Preferably, each leg of each leg pair in the table erected (unfolded) configuration is slightly canted outwardly when the leg pair is erected and extended. In the leg erected configuration, the respective length of each of the two leg-associated cable members is such that each cable member extends straight. These leg-associated cable members function to brace and restrain the associated leg from rotating or from moving longitudinally or transversely outwardly.

For structural reasons, preferably these cables are associated with each end of a cross brace located adjacent to and interconnecting with each leg of a leg pair. The legs and cables cooperate so that, when the legs are in their down and locked (erected) positions, the inner and outer leg cables are held taut by the cross member and the legs cannot rotate in either direction. When unlocked and the legs are pivoted upwards into a folded position, sufficient slack is created in the cables to allow the legs to be pivoted to their closed (i.e., folded) position.

When the inventive table is in its erected (unfolded and assembled) configuration, the three platform sections are unfolded and cooperate to define the working platform. To maintain this platform in its erected (unfolded) configuration, and to permit the platform to support loads, a pair of elongated platform support cables are preferably employed whose respective opposite ends are directly or indirectly fixed to respective opposite longitudinal end portions of the platform. Thus, an elongated cable member preferably extends generally along, under, and in inwardly spaced relationship to, each opposed longitudinal side portion of the flat platform while the opposite end of each respective cable is preferably fastened to an opposite outer end portion of each end section.

An elongated rigid platform-to-cable load transfer bar (or truss leg assembly) is preferably provided for each cable. Each bar is preferably positioned so as to extend downwardly from a different opposite longitudinal side region of the platform and preferably is in the same vertical plane as that of one cable in the erected configuration. Preferably, one load transfer bar is associated pivotably with each platform end section at a location adjacent to the platform center section. Engagement of each cable member with its associatable bar can be achieved, if desired, after the platform is unfolded. The relationship between each cable member and its associated bar is such that, when the three platform sections are fully open so to define the flat working platform, each cable member is tensioned so that it angles diagonally downwardly from each platform end region to the associated load transfer bar. Thus, weight on the platform upper or top surface is transferred through the bars to the cable members which effectively act as load carriers.

One now preferred embodiment employs at least one telescoping platform-to-cable load transfer bar. Such a bar advantageously minimizes weight. For improved rigidity, an inventive table may have two platform-to-cable load transfer bars, both collinear with their respective cable members, one telescoping and one not telescoping. As can be seen in a side view of a table embodiment assembly, these bars are preferably slanted slightly inward. Preferably the bars have telescopically interconnecting sections so that the associated cable ("truss cable") may be engaged in a notch at or across the bottom end of each bar so that then an associated cable can be brought to a lightly tensioned state by extending each platform-to-cable load transfer bar to its full length. Each bar is then held from rotating to a closed configuration preferably by the geometry of the cable/transfer bar and each bar is preferably held from rotating further open by a backstop means in its hinge design. Preferably, all cable tension adjustments are achieved by threaded screw means at the outer section edges, such as eye-bolts or the like.

To permit the assembled and erected table to be folded, each load transfer bar is pivotally mounted adjacent to the inside end of each end section and is adapted for pivoting so as to be adjacent the associated end section underside yet remains adapted for erection when the table is erected for use. To permit adjustments in cable tensioning, preferably the longitudinal length of each load transfer bar is adjustable.

Preferably, the platform sections each comprise a peripheral frame structure comprised of interconnecting components that are themselves comprised of molded plastic or the like. The components are fastened together with an adhesive or other means. Such a frame structure permits virtually infinite permutations in table geometry.

Preferably, platform sections each have panel surface portions that are preferably defined by a perimetrically flanged plate-like member that is received on a frame structure and is fastened thereto with an adhesive or other means. Preferably, each plate-like member is a composite, sandwich-type panel comprising of two thin, opposed outside skins with a honeycomb-type core structure bonded therebetween. For added rigidity without added weight, the lower skins may be formed with raised areas such as beads, ribs or the like in surface areas where the raised areas will not conflict with folding of table components.

Preferably, the entire subassembly of platform supporting components for the platform's erected configuration is positionable beneath or within the various three sections when the table is in its folded configuration.

When, and if, a platform is adapted for positioning on a floor surface or the like in a stable, flat, unfolded configuration the subassembly of platform supporting components is positionable beneath the sections. Thus, in a preferred embodiment, a person can lie full length or prone on the unfolded platform upper surface without contacting the supporting components.

The upper surface portions of each section can be constructed as desired, depending upon the anticipated end uses contemplated. Preferably, the upper surface portions of each of the platform sections are somewhat resilient or padded, thereby to exert a cushioning effect upon a person lying full length on the unfolded platform.

Preferably, the platform-to-cable load transfer bars each have a section catch means. Preferably, such a section catch means is constructed so that if the erected table, when the platform is unfolded, is lifted by its mid-section for re-positioning, then the end platform sections will not fold downward. Typically, the hinges used in a table embodiment can only support loads in a downward direction. A section catch means preferably achieves this function and avoids end section folding by providing a stop means between the associated edge members of the end and center panels that limits or prevents section folding in an erected table with an unfolded platform.

When in its unfolded and fully erected configuration, the inventive folding table is sturdy, rigid, strong and generally suitable for usage as a table whose platform is load-bearing and adapted for use as a working structure.

When in its folded and fully collapsed configuration, the inventive folding table is preferably easily and conveniently transported or carried by one man. Moving or relatively flexible components are preferably internally housed within the folded associated sections during storage and transport.

The inventive table is relatively lightweight, easy to fabricate, store and use, reliable and durable. It is well suited for many applications, repeated assembly and disassembly, long-term usage, and usage in various environments and conditions.

Particularly when upper surfaces of the platform sections are padded, the inventive table is well suited for use in massage by Feldenkrais practitioners.

When upper surfaces of the platform are unpadded, the table is useful for military applications and field use.

Other and further objects, aims, purposes, features, advantages, embodiments and the like will be apparent to those skilled in the art from the disclosures of the specification taken with the accompanying drawings and the appended claims.

BRIEF DESCRIPTION OF THE DRAWINGS

In the drawings:

FIG. 26A through FIG. 26D show progressive positions of the assembled hinge assembly of FIGS. 24 and 25 as this hinge assembly is moved from a fully closed position as shown in. FIG. 26A to a fully open or extended position as shown in FIG. 26D;

Cable and leg members in views 27–34 are shown. fragmentarily for convenience.

DETAILED DESCRIPTION

Figure 1:
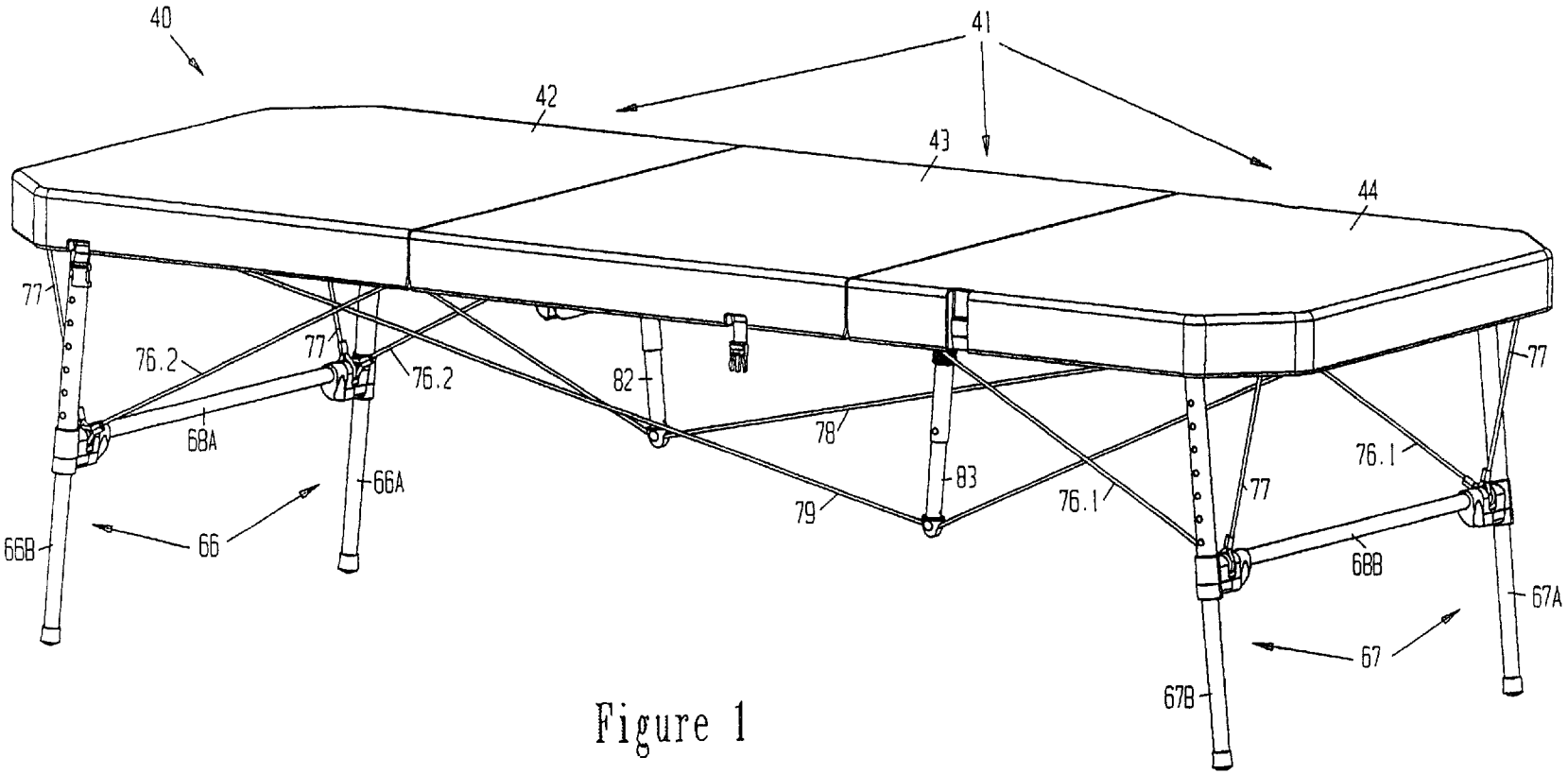
FIG. 1 is an isometric view of one embodiment of a folding table of the invention in its fully assembled and erected configuration.
Figure 2:
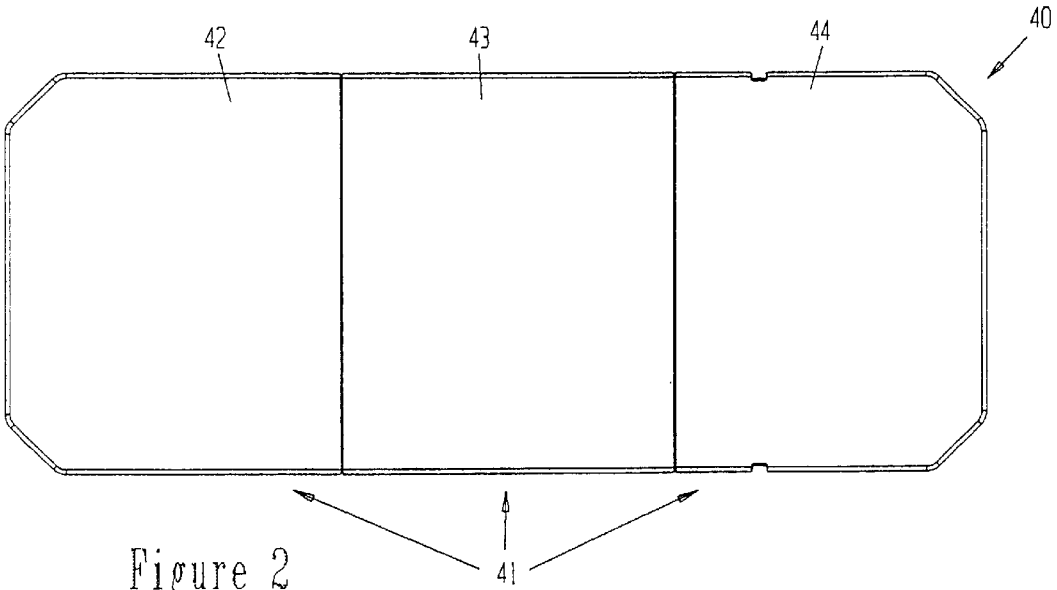
FIG. 2 is a top plan view of the table of FIG. 1.
Figure 3:
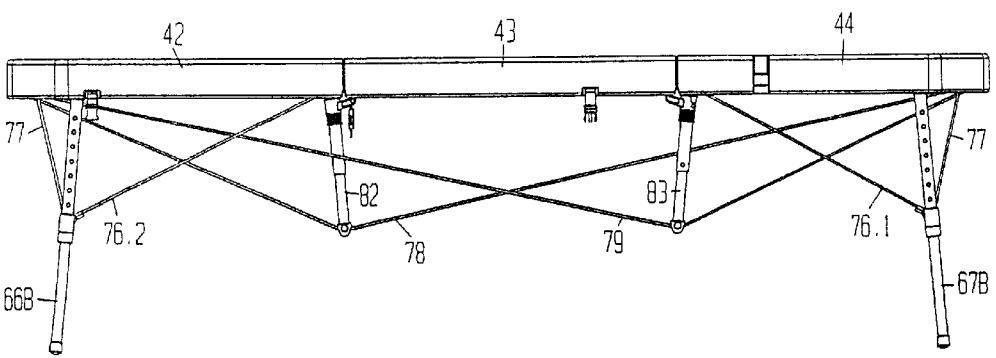
FIG. 3 is a side elevational view of the table FIG. 1.
Figure 11:
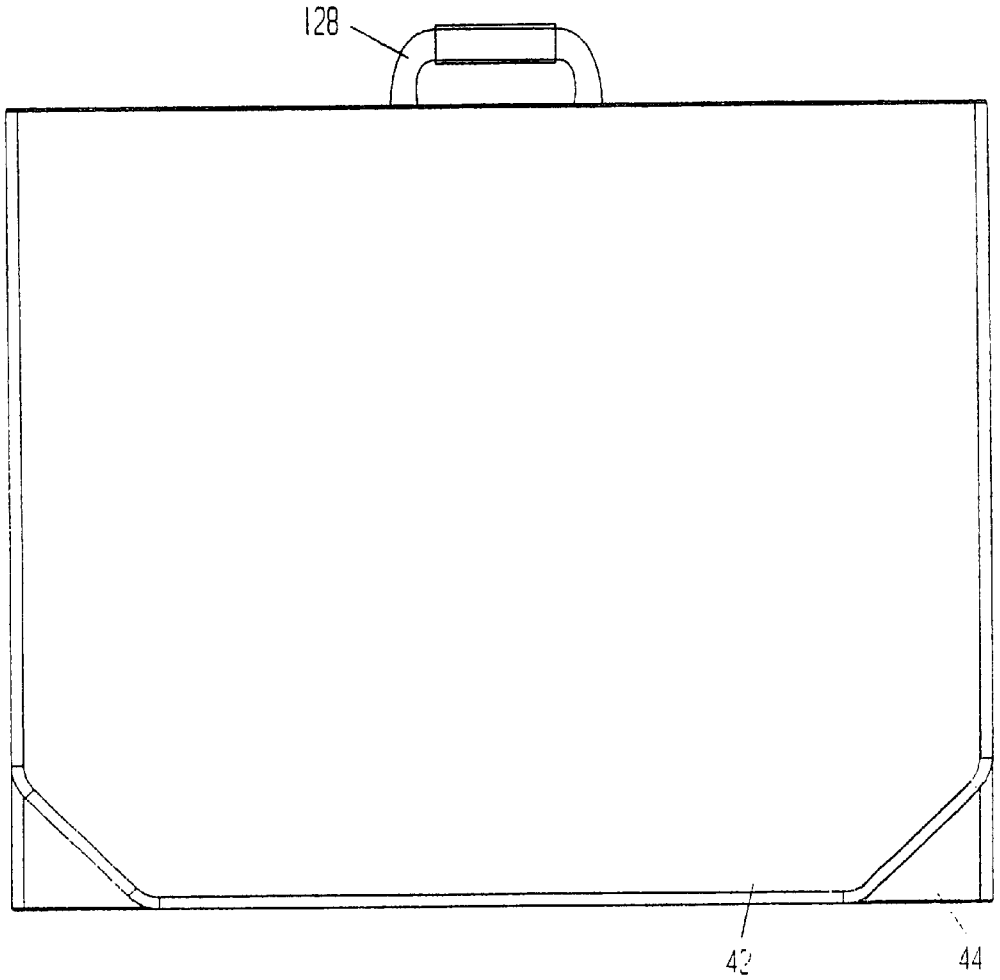
FIG. 11 is a side view of FIG. 8.
Figure 10:
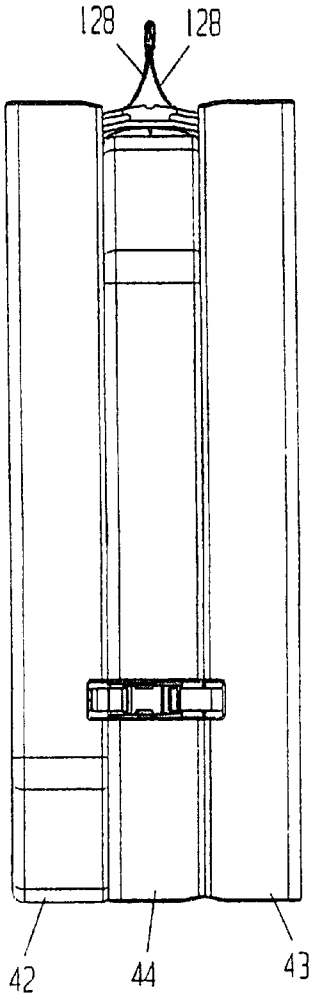
FIG. 10 is an end elevational view of FIG. 8.

Referring to the drawings, there is seen one embodiment of a folding table 40 of the invention. Table 40 incorporates a working platform 41 that can have a generally flat configuration, such as shown, for example, in FIGS. 1, 3 and 4, and that can also have a generally folded configuration, such as shown, for example, in FIGS. 8, 10 and 11.

Platform 41 has three generally flattened sections 42, 43 and 44 that are in adjacent, successive relationship to one another so that the sections 42 and 44 are identified for convenience as respective first and second end sections that each have one side 46 and 47, respectively, that is adjacent to a different opposed side 48 and 49, respectively, of the center section 43. For each of the sections 42, 43 and 44 various structures can be employed although it is presently preferred that the same type of structure be employed for each section 42, 43 and 44. Presently preferred structures for each section 42, 43 and 44 are shown in the Figures and described hereinbelow. A downwardly extending peripheral frame flange 51, 52 and 53, respectively, preferably and as shown, extends about each section 42, 43 and 44.

A pair of first hinges 57 and 58 is provided for interconnection of sections 43 and 44. Each hinge 57 and 58 is inwardly spaced from an adjacent transverse side of platform 41. The hinges 57 and 58 pivotally interconnect the side 47 of first end section 44 with the adjacent side 49 of mid (or center) section 43. The interconnecting first hinges 57 and 58 allow the section 44 to be pivoted through about 180° relative to the section 43 so as to bring the back or under side of section 44 into adjacent relationship with the back or under side of section 43 with the terminal lower edge portion of the frame flanges 52 and 53 being in adjacent contacting relationship with one another. As those skilled in the art will readily appreciate, various conventional hinge structures can be utilized as the hinges 57 and 58. A presently preferred hinge structure for hinges 57 and 58 is described hereinbelow.

A pair of second hinges 55 and 56 is provided for interconnection of sections 43 and 42. Each hinge 55 and 56 is inwardly spaced from an adjacent transverse side of platform 41. The hinges 55 and 56 pivotally interconnect the side 46 of second section 42 with the adjacent side 48 of center section 43. The interconnecting second hinges 55 and 56 allow the section 42 to be pivoted through about 180° relative to the section 43 so as to bring the back side or under side of section 42 into adjacent relationship with the front (or top) side of section 44 with the terminal lower edge portion of the frame flange 51 being generally in contacting relationship with the top surface of pad member 143 of section member 44 or, the top surface of section member 44 when the top surface of a section member is unpadded.

To avoid the component interference problems that would otherwise occur, as those skilled in the art will readily appreciate, the hinges 55 and 56 are preferably, and as shown, laterally reversibly extendable. Thus, when the platform 41 is in its generally flat (or unfolded or erected) configuration, the sides 46 and 48 of sections 42 and 46, respectively, are in a contiguous adjacent relationship comparable to that concurrently associated with the sides 47 and 49 of sections 44 and 43, respectively; yet, when the platform 41 is in its generally folded configuration, the hinges 55 and 56 each laterally (or longitudinally relative to the flat platform 41) extend so that the sides 46 and 48 are in a spaced, parallel, adjacent relationship. In the platform 41 folded configuration, this spacing is sufficient to accommodate the thickness of the first folded section 44 that is located between the sections 42 and 43.

Various laterally extendable hinge structures can be utilized in the hinges 55 and 56, as those skilled in the art will readily appreciate. However, in the presently preferred table 40, each of the hinges 55 and 56 have a similar structure. The presently preferred structure for hinges 55 and 56 is described hereinbelow (see FIGS. 24–26).

In the assembled and erected state of the table 40, the platform 41 is in its generally flat configuration and platform 41 is supported in upwardly spaced, horizontal relationship relative to an underlying ground or floor surface (not detailed) by two pairs 66 and 67 of supporting leg members 66A and 66B, and 67A and 67B, respectively. Each leg pair 66A and 66B includes an interconnecting cross brace 68A, and each leg pair 67A and 67B includes an interconnecting cross brace 68B. Each cross brace 68 extends preferably medially between its associated leg members 66A and 66B, and 67A and 67B. When the table 40 is in its fully assembled and erected state, each cross brace 68A and 68B is rigidly associated with each leg member of each pair of legs, and also each individual leg member is rigid. While various structures can be employed for the leg members 66A, 66B, 67A and 67B, and for the cross braces 68A and 68B, as those skilled in the art will readily appreciate, in the presently preferred table 40, the leg pairs 66 and 67 and the cross braces 68 have respective structures as further described hereinbelow.

A connector 69 (four) is provided for pivotally connecting an upper end portion of each leg member 66A, 66B with first end section 42, and for so connecting an upper end portion of each leg member 67A and 67B with second end section 44. Preferably, and as shown, each connector 69 is fixedly connected to the back side of each section 42 and 44 at an outer corner region.

A connector 69 is preferably connected to each outer corner region of each respective section 42 and 44 so that each pair 66 and 67 of the leg members 66A and 66B, and of 67A and 67B together with their respective interconnected cross braces 68A and 68B, is adapted for concurrent pivotal leg movements relative to its associated section 42 or 44 (as the case may be). Various connectors can be employed as those skilled in the art will readily appreciate. Structural details of the presently preferred connector 69 and its connection to a leg member are described hereinbelow.

Each leg member 66A, 66B, 67A and 67B is preferably in its mid-region associated directly or indirectly with an end region of each of two different cable members 76 and 77. For structural purposes, it is preferred in table 40 to associate each of these two cable members with each respective leg indirectly by associating each cable member 76 and 77 with the leg-adjacent opposite end portion of each one of the cross braces 68.

Figure 19A:
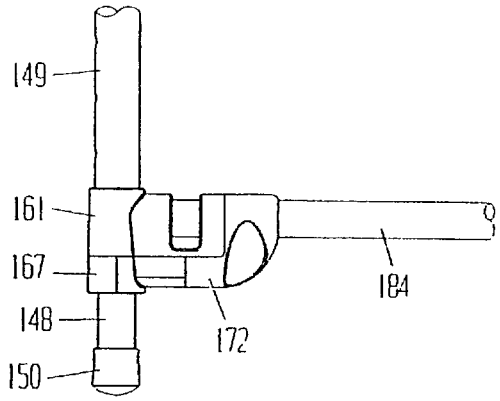
FIG. 19A and FIG. 19B show the leg assembly of FIG. 15 in an assembled configuration in the region of the cross bar catch with the lower leg telescopically received into the upper leg and with the cross bar catch in its closed position, FIG. 19A showing a fragmentary side elevational view and FIG. 19B showing the same view in axial cross section.
Figure 19B:
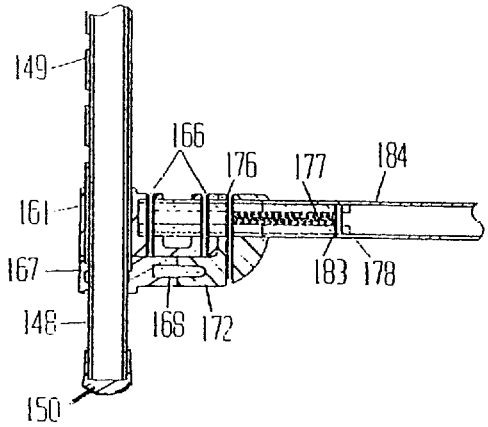
Figure 20A:
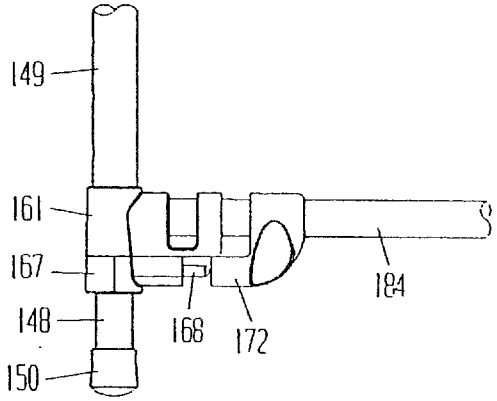
FIG. 20A and FIG. 20B are similar to FIG. 19A and FIG. 19B, respectively, except that the cross bar catch is in its open position.
Figure 20B:
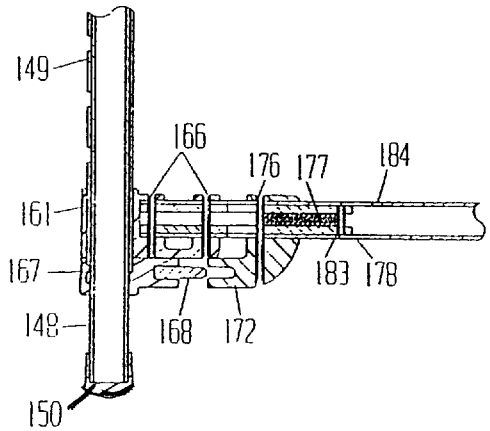

The cross braces 68 are each adapted to slide up and down on their respective associated leg members and to lock in the leg downward (erected) position, such as is shown, for example, in FIGS. 19–21. The result is that the cables 76 and 77 are taut in the assembled and erected position, thereby locking and avoiding leg rotation in another direction. By sliding a cross brace 68, tension on the associated cable 76 or 77 is released, allowing the associated legs to be folded closed.

Although various cable end connection means can be employed, as those skilled in the art will readily appreciate, the presently preferred cable end connection means for the cable members 76 and 77 and each leg member 66 and 67 at the cross brace 68 jointure with each leg are described hereinbelow.

From the leg-adjacent, cross brace 68 cable member connection region for each leg member, each cable member 76 extends upwardly and diagonally generally parallel to the adjacent longitudinal side of the associated respective end section 42 and 44 to a location where the opposite end of cable member 76 reaches and is connectable to the associated respective end section 42 and 44. Preferably, each cable member 76 has a length sufficient to reach to the inner side 46 or 47 of such end section 42 or 44, and most preferably each cable member 76 extends to reach the nearest one of the respective hinges 55, 56, 57 and 58.

Thus, for leg members 66A and 66B, the respective cable member 76 extends to one hinge 55 or 56, as the case may be, while for leg members 67A and 67B, the respective cable member extends to one hinge 57 or 58, as the case may be. For reasons of structural integrity, which those skilled in the art will readily appreciate, the upper end portion of each cable member 76 is preferably and as shown connected with a portion of one hinge 55, 56, 57 or 58, as the case may be. Although various connection means for cable member 76 to section member 42 or 44 can be employed as those skilled in the art will appreciate, it is presently preferred to employ a cable to hinge-associated connection means for each cable member 76 as described hereinbelow.

Figure 7:
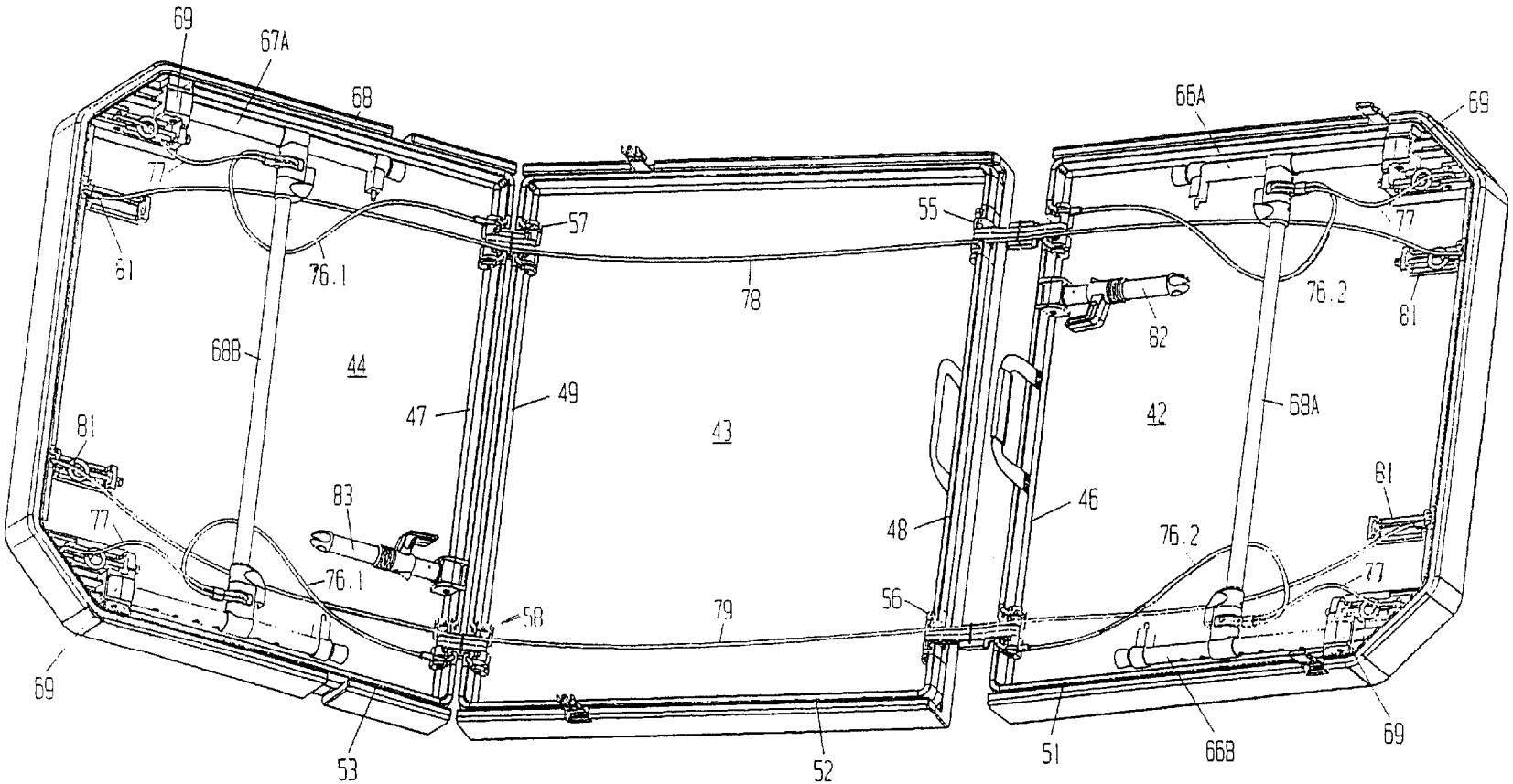
FIG. 7 is an isometric view similar to FIG. 5, but showing bottom and side portions of the FIG. 1 table platform at the beginning of a section folding operation the table being rotate 180° from the orientation shown in FIGS. 1–4 is that here the respective table opposite ends are reversed left to right.

Similarly, for each leg member 66 and 67, but from the associated end region of the cross brace 68 that is connected thereto, the associated cable member 77 extends upwardly and somewhat diagonally so that the opposite end of cable member 77 reaches and is connectable to the underside of the respective associated end section 42 or 44. Preferably, each of the cable respective members 77 of each leg extends at least to the connector 69 for that particular associated leg member. The upper opposite end of each cable member 77 is preferably fastened to the end region of the adjacent respective end section. For reasons of structural integrity, which those skilled in the art will readily appreciate, the upper end portion of each cable member 77 is preferably and as shown connected with a portion of the same connector 69 (see, for example, FIG. 7) that connects each leg member 66A, 66B, 67A and 67B. Although various cable member 77 to section member 42 or 44 connection means can be employed, it is presently preferred to employ a cable to end connector 69-associated connection means for each cable member 77 as described hereinbelow.

Preferably and as shown, each leg member in its erected position relative to the other leg members of each leg pairs 66 and 67 is similarly slightly canted outwardly at a similar angle (relative to other leg members) so that each leg member bottom end is located more towards the end of the associated end section than it would be if the individual leg member bottom end were to extend perpendicularly downwardly from each associated connector 69 on the back side of the flat platform 41 in its flat configuration. When in its erected orientation, each leg member 66A, 66B, 67A and 67B has its respective associated cable members 76 and 77 preferably in a generally straight orientation and preferably in a slightly tensioned condition. Thus, the cable members 76 and 77 of each leg member 66A, 66B, 67A and 67B coact with the respective associated cross brace 68 and function to brace and restrain each leg member from rotating or from moving longitudinally or transversely outwardly in the fully erected or unfolded table 40.

In effect, the cable members 76 and 77 replace what would otherwise be diagonal elongated rigid bracing members, such as are conventional for rigidifying the foldable leg members of certain prior art foldable tables, for example, card tables or the like. The cable members 76 and 77 are not only strong but also light in weight, compared to such prior art bracing means.

Alternatives to the cables 76 and 77 can be employed, if desired, such as retractable, foldable, or telescoping bars, or the like.

As explained hereinbelow, when table 40 is folded from in its erected state into a storage configuration, the legs members 66A, 66B, 67A and 67B are each telescopically shortened and the cross braces 68 are released and slid upwards, releasing tension on cables 76 and 77, allowing the legs to be rotated upward and pivoted on their respective associated connectors 69 so that each leg pair 66 and 67 rests against the underside of each end section 42 and 44 together with their associated cross brace 68. As above-indicated, although alternative arrangements will be apparent to those skilled in the art, details of the presently preferred leg member and cross brace structures and the cable arrangement are provided hereinbelow.

For supporting the platform 41 in its flat, upheld configuration when the table 40 is erected, two elongated platform supporting cable members 78 and 79 are provided. Each of the cable members 78 and 79 extends beneath the platform 41 when same is in its flat and unfolded configuration with these cable members 78 and 79 preferably being in a transversely spaced and parallel planar relationship relative to each other. Preferably, each cable member 78 and 79 is inwardly spaced from an adjacent longitudinally extending opposite side portion of the platform 41, thereby to minimize any interference with use of the erected table 40 by a person standing or even sitting alongside of the table 40.

The respective opposite ends of each cable member 78 and 79 are fastened to the bottom surface of each end section 42 and 44 preferably at locations that are adjacent to the outside end of each such end section. Various cable end fastener means can be employed for mounting and holding respective opposite ends of each of the cable members 78 and 79. Preferably two cable end fasteners 81 are each fixed symmetrically and in transversely spaced relationship to each other to the back side of each end section 41 and 44 adjacent to the outside longitudinal end thereof. Various structures can be employed for the cable end fasteners 81 (four in table 40), as those skilled in the art will readily appreciate. Preferably, each cable end fastener 81 has the same or similar structure. A presently preferred cable end fastener 81 is described hereinbelow. As each of the platform cable members 81 is 78 and 79 is so fastened to a cable fastener 81 at its respective opposite ends, the length of the cable is greater than the shortest possible distance between each pair of cable end fasteners 81.

Also, for supporting the platform 41 in its flat configuration when the table 40 is erected, two platform-to-cable load transfer bars 82 and 83 are utilized. Each bar 82 and 83 downwardly extends from the back side of the platform 41. Preferably, the proximal end of each bar 82 and 83 is pivotally associated with the platform 41 back side and is located so as to be vertically positioned over a different one of each of the cable members 78 and 79 for vector force transfer reasons, as those skilled in the art will readily appreciate. Preferably, the proximal end of each bar 82 and 83 is located at or along a different side 46 or 47 each section 42 and 44, respectively. The lower outer distal end of each bar 82 and 83 is preferably configured for resting engagement along a different respective one of the cable members 78 and 79 although various alternative cable-to-bar association means can be employed as those skilled in the art will appreciate. conveniently and preferably, each bar 82 and 83 distal end has a cable receiving groove 84 defined therein. Thus, the bar 82 distal end can engage cable member 78 and the bar 83 can engage cable members 79. In place of grooves 84, other cable association or attachment means can be employed.

The relationship between the bar 82 and the cable member 78, and also between the bar 83 and the cable member 79, is such that, when the platform 41 is in its flat configuration and each cable member 78 and 79 is engaged with its bar 82 and 83, the cable members 78 and 79 are each drawn tight or tensioned so that each cable member 78 and 79 extends between its associated respective bar 82 and 83 and each of its respective opposite cable end fasteners 81 in about a straight line. Hence, when a load is placed on the upper surface of the flat platform with the erected table 40 and oriented in a normal table use configuration, the weight of the load is transferred from the platform 41 through the load transfer bars 82 and 83 to the respective associated cable members 78 and 79. These cable members 78 and 79, in effect, support the platform 41 and the load thereon.

As those skilled in the art will readily appreciate, the load transfer bars 82 and 83 can have various structures. Preferably, each bar 82 and 83 utilize the same structure. The presently preferred structure for a bar 82 and 83 described hereinbelow.

When the assembled table 40 is disassembled and folded for storage or transport, the cable members 78 and 79 are preferably disengaged from their respective associated bars 82 and 83 as the bars 82 and 83 telescope and pivotably move upward. As described hereinbelow, each bar 82 and 83 is pivotally moved from its extended position in the assembled table 40 to a storage position where bar 82 rests against the underside of section 42 and where bar 83 rests against the underside of section 44. As the sections 42 and 44 are pivoted, the cable members 78 and 79 are positioned so as to overlie exterior surface portions on the platform 41 back side of each of the hinges 55, 56, 57 and 58. In the fully folded platform 41 configuration, all of the cables 76, 77, 78 and 79, and both leg pairs 66 and 67, with their respective cross braces 68A and 68B, are fully contained within and housed by the sections 42, 43 and 44.

Component Structure: Sections

Each of the sections 42, 43 and 44 can be variously constructed, as those skilled in the art will readily appreciate. In the presently preferred practice of this invention, each section has a similar construction including a peripheral frame and a medral panel whose perimeter associates with the frame.

Figure 14:
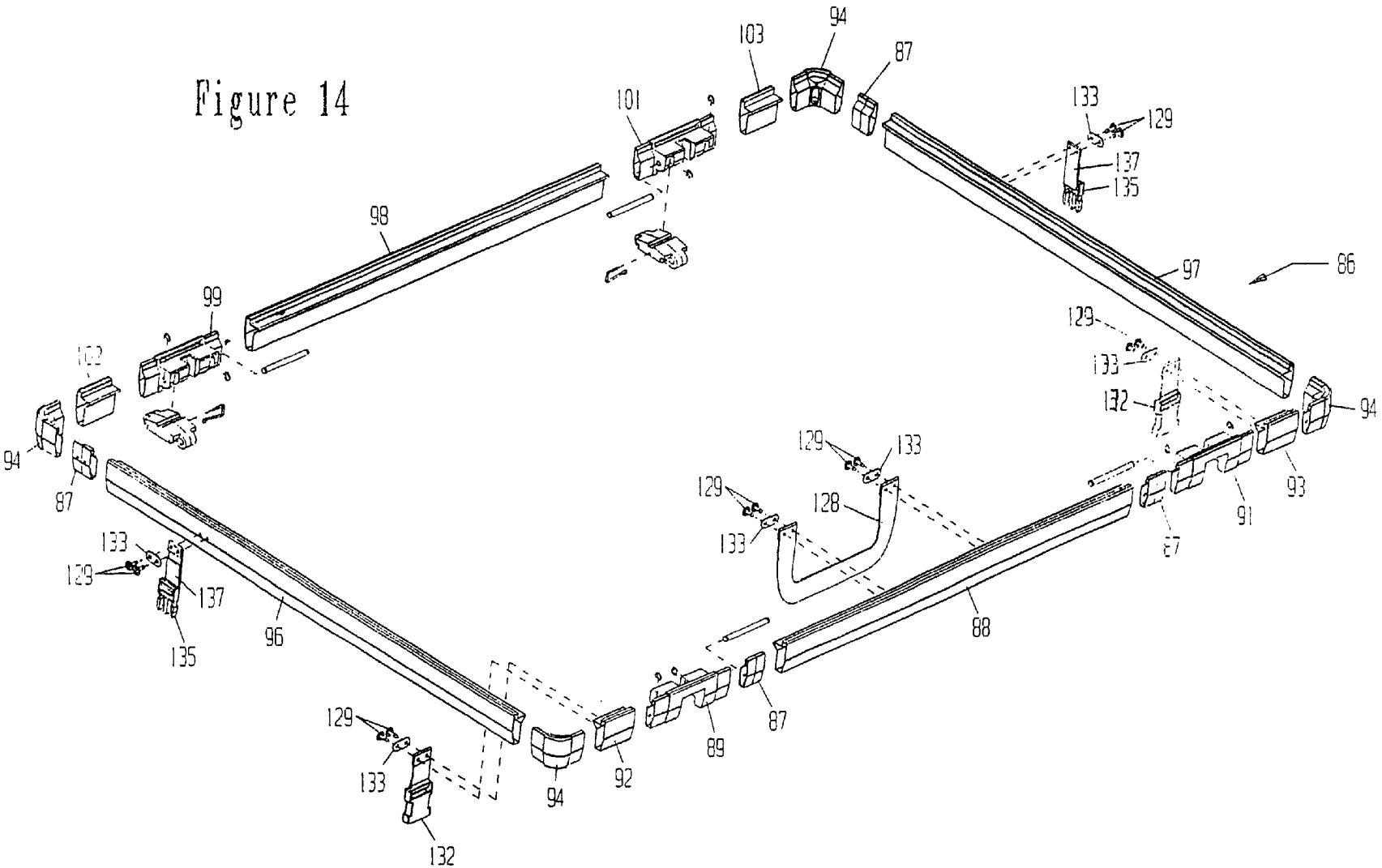
FIG. 14 is a view similar to FIG. 13, but showing the center section of the FIG. 1 table platform.
Figure 15:
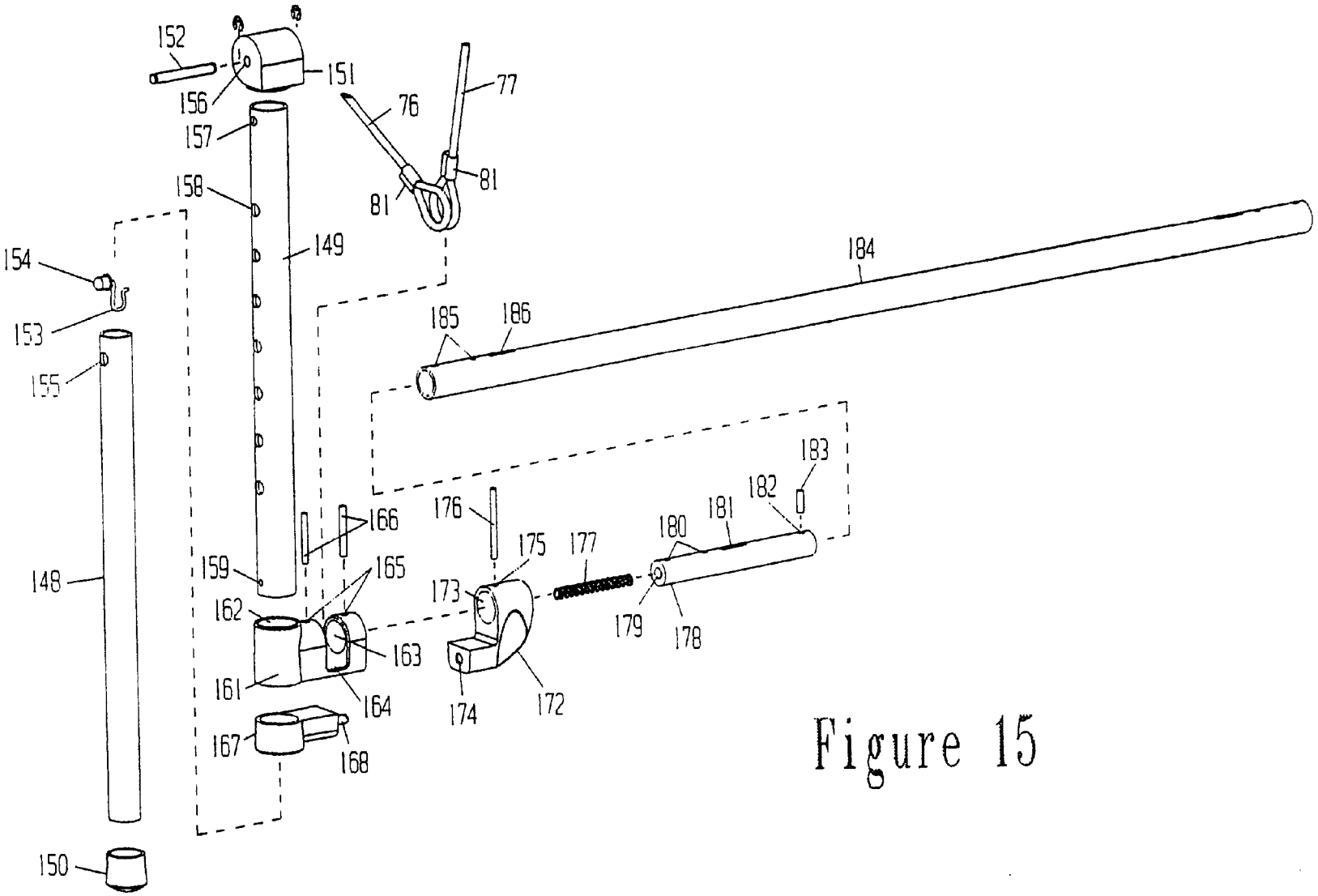
FIG. 15 is an isometric exploded view of one leg assembly and its associated components.

Center section 43 incorporates a peripheral frame 86 (see FIG. 14) that employs a frame structure comprised of a plurality of interfitting components. The components include runner sections and base sections, as illustrated and described herein. Thus, along each side of the frame 86, main runners are included. Each runner is preferably a length of a preformed extrusion that is comprised of metal or plastic and that is preferably hollow although other runner constructions can be employed, if desired. Each runner has opposite ends that can function as female connectors that interfit (that is, receive thereunto) various other base components that have associatable male connectors at each opposite end. These other components are here also preformed and comprised of molded metal or plastic. As those skilled in the art will readily appreciate, the exterior configuration of the individual base components can be variously comprised. Such other components include, for example, runner section end reinforcement inserts 87. Each insert 87 has opposed end portions that each slidably fit into one end of a runner. Each insert can also slidably entirely fit inside a runner. Each insert 87 can function not only to connect, but also to reinforce an associated usually relatively thin-walled runner. The reinforcement is particularly desirable in runner regions where mechanical fasteners, such as rivets, screws or the like penetrate a runner side wall, thereby to achieve attachment of further components, such as described below. In place of inserts 87, metal or plastic backing plates (not shown) can be employed, if desired.

In center section 43, each opposite end of runner 88 (see FIG. 14) receives one end of an insert 87 and the other end of each insert 87 is then inserted into one female end of a hinge leaf member 89 and 91 respectively (described below). Each respective opposite female connecting end of each hinge leaf member 89 and 91 is fitted with one end another insert 87, and the opposite end of the insert fits into one end of a short linking runner 92 and 93, respectively.

Each of the four corners of the frame 86 is provided with end defined by a different one rounded inside corner block 94. Each corner block 94 has a pair of terminal end connecting extensions that are disposed at 90° relative to each other. Each such end extension of a corner block 94 is adapted to slidably engage an adjacent end of a runner. Here, linking runner 92 and 93 slidably engages a different one connecting extension of a different corner block 94. One transversely extending side of the frame 86 is thus comprised of an interfitting combination of components.

Each opposed longitudinally extending side of frame 86 has a runner section 96 and 97, respectively. One end of each runner section 96 and 97 receives therein one end of an adjacent corner block 94, while, at the opposite end thereof, each runner section first receives therein an insert 87 for reinforcement purposes, and then receives therein one connecting extension of a different corner block 94 thereby completing each longitudinally extending side.

The other transversely extending side of frame 86 includes a runner section 98 each of whose opposite ends receives therein the female terminal side extension of a different hinge leaf member 99 and 101. The opposite female end terminal side extension of each hinge leaf member 99 and 101 is received into one end of a different short linking runner 102 and 103, respectively. The opposite end of each linking section 102 and 103 receives therein one end of a different corner block 94, thereby completing this transversely extending side of frame 86 and the frame 86.

Figure 12:
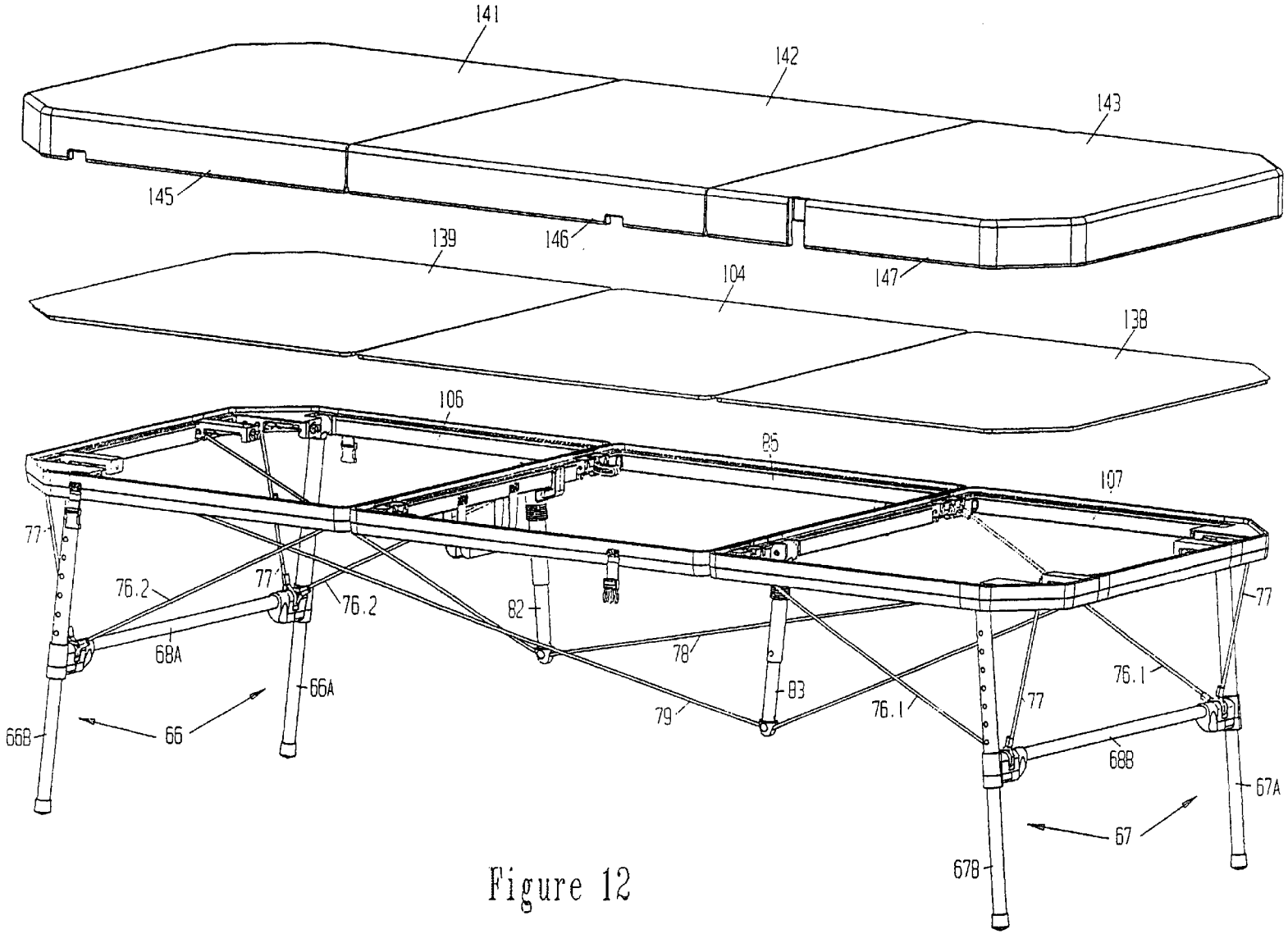
FIG. 12 is a view similar to FIG. 1, but showing the platform in a partially exploded configuration.

Each of the exposed (or exterior) components of the frame 86 defines along its interior upper side an integral and continuously extending shoulder that extends around the frame perimeter. The shoulders of the individual contiguous components are formed so as to be in end-aligned relationship relative to one another. The continuously extending shoulder is thus adapted to receive and hold in an edge supporting relationship the perimeter-adjacent edge regions of a surface-defining panel member 104 (see FIG. 12) that is itself preferably unitarily formed. The panel member 104 can be comprised of various materials, such as plywood, pressed board, particle board, filled plastic or the like.

Figure 13:
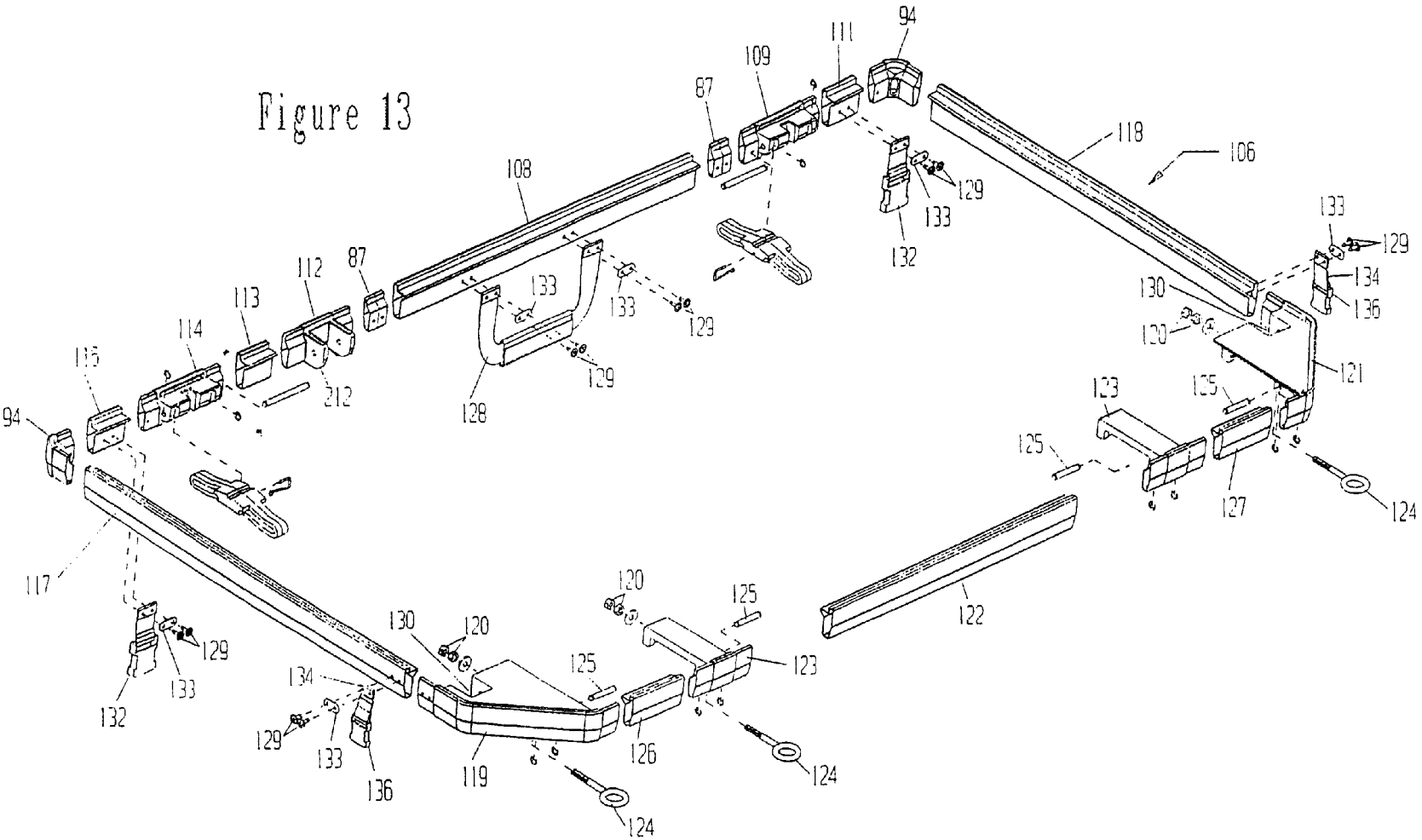
FIG. 13 is a fragmentary exploded view showing edge frame components of one end section of the FIG. 1 table platform

All components of a frame 86, 107 or 106, and their associated panel components 138, 139 and 104 are conveniently assembled together using an adhesive, such as an epoxy resin or the like so that the section assemblies become integral and rigid section structures The two end sections 42 and 44 each incorporate a similar perimeter frame 106 and 107, respectively. The preferred structure of frame 106 is representative of both frames 106 and 107 and is shown in FIG. 13 (note location of strap 128). The view shown in FIG. 13 is similar to that shown in other figures such as FIGS. 14, but is rotated to provide a view of table 40 from an opposite end in order to show closure strap members (described below).

The transversely extending inward side of frame 106 includes a runner 108 that receives in each of its opposite ends a different insert 87. One end of the runner section 108 receives therein one of the opposite female ends of a hinge leaf member 109 (described below). The other female end of the hinge leaf member 109 is received into one end of a linking runner 111. The opposite end of the linking runner 111 receives an end extension of a corner block 94. The opposite end of the runner section 108 receives therein one opposite female end of a hinge body 112 that is provided for pivotal support of the upper end of a load transfer bar 82 or 83 as described below. The opposite female end of the hinge body 112 is received in one end of a linking runner 113. The opposite end of the linking runner 113 receives therein one opposite female end of a hinge leaf member 114 as described below. The opposite female end of the hinge leaf member 114 is received into one end of a linking runner 116. The opposite end of linking runner 116 has received there into one end extension of a corner block 94.

Each of the longitudinally extending opposite sides of the frame 106 includes a different runner 117 and 118. One end of each such runner plug fits about the respective projecting opposite end of a different one corner block 94. The opposite end of each runner section plug fits about one projecting connecting end of a different unitarily formed outside corner block 119 and 121 as described below.

The transversely extending outward side of frame 106 includes a runner 122 that has each one of its respective opposite ends receiving a different projecting one opposite connecting end of a different cable end mounting bracket 123 (paired; described below). The opposite connecting end of each bracket 123 is received into one end of a different respective linking runner 126 and 127. The opposite end of each of these linking runners 126 and 127 receives therein the opposite projecting end of a different outside corner block 119 and 121.

Like the frame 86 of section 43, each of the exposed (or exterior) components of the frame 107 of section 94 defines along its interior upper side a shoulder portion, and the individual shoulders are contiguous and in end-aligned relationship relative to one another. These shoulders taken together are thereby adapted to receive and hold in supporting relationship the perimeter-adjacent edge regions of a panel member 138 (see, for example, FIG. 12) that is itself preferably unitarily formed preferably similarly to panel member 104. The frame 106 of section 42 is provided with a similar panel member 139.

In overlying relationship to each of the panel members 139, 104 and 138 a molded and upholstered foam pad 141, 142 and 143, respectively, is preferably positioned. Exposed side edges of each of these pads 141, 142 and 143 is provided with a downturned outside perimeter flange 145, 146 and 147, respectively, that extends downwardly below each of the frames 106, 86 and 107.

The pads 141, 142, 143 are conveniently optionally and preferably constructed of an upholstered molded foam material. The table 40 and these pads cooperate and are configured so that the geometry of the pads does not interfere with the articulation of the section members. These pads are conveniently fastened to the respective adjacent section top surfaces with some sort of removable attachment means, such as a hook and loop (e.g., "Velcro" type) fastener, a double stick foam attachment tape such as used in the automotive industry, or the like. The feature of allowing these pads to be removed for cleaning or replacement after damage or wear is not currently known for any now known folding padded tables.

To permit the lifting and transporting of the table 40 when it is in its folded configuration, handle carrying means is provided. Various carrying means can be utilized as those skilled in the art will appreciate. In the now preferred embodiment 40, the mid-region along the transversely extending inner side of frame 107 of section 44, and also the mid-region of the adjacent transversely extending side of frame 86 of section 43 are each provided with a conventional handle 128. Conveniently, the foot of each handle 128 is mounted to its associated runner 108 and 88, respectively, by means of rivets 129 that extend through each foot end of each handle 128, pass through the runner side wall, and enter into an insert 87 that has been slidably moved from the end of each associated runner through the runner into transverse alignment with the rivets for each handle base end.

Figure 4:
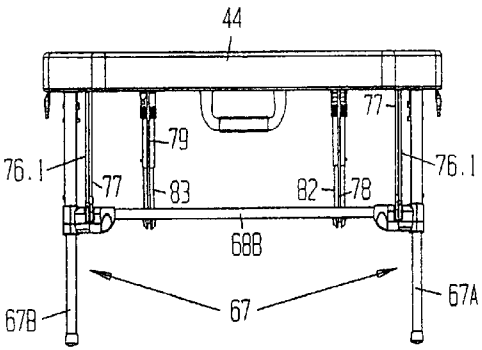
FIG. 4 is an end elevational view of the table of FIG. 1
Figure 5:
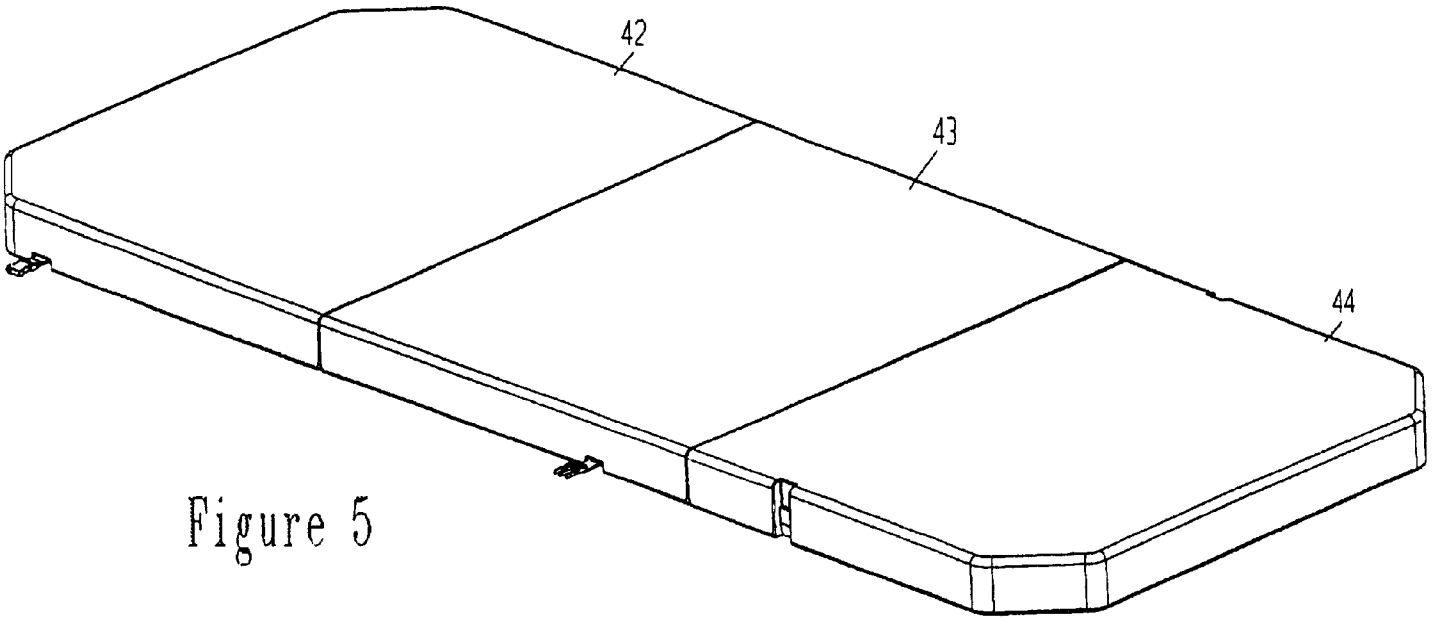
FIG. 5 is an isometric view showing top and side portions of the platform of the Table of FIG. 1 with all leg and other components in their respective folded or dissembled states and disposed beneath the platform.
Figure 6:
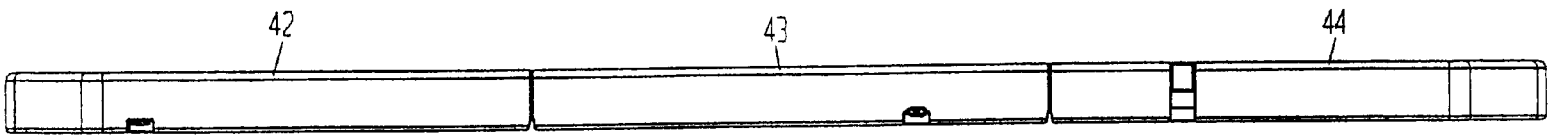
FIG. 6 is a side elevational view of the table configuration of FIG. 5.
Figure 9:
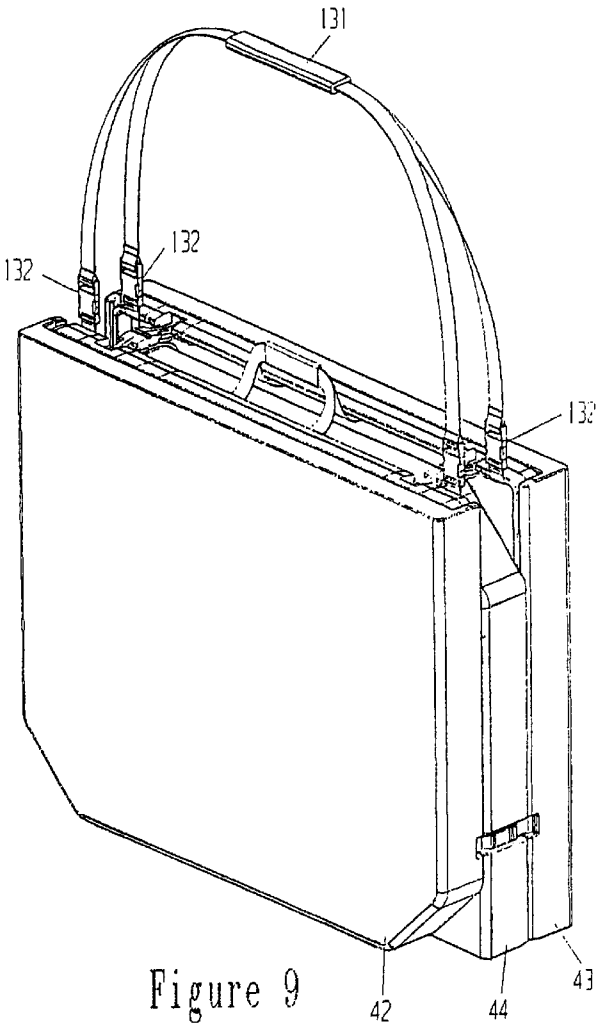
FIG. 9 is a view similar to FIG. 8, but showing the folded table in association with an optional shoulder strap.

Optionally, a folded table 40 can be also provided with a shoulder strap 131 such as illustrated, for example, in FIG. 9 for lifting and transporting purposes. For purposes of shoulder strap 131 attachment, the frames 107 and 86 are each provided with a cooperative shoulder strap buckle assembly 132. Thus, as shown in FIGS. 13 and 4, one buckle assembly 132 is mounted by rivets 129 or the like to each one of the linking runners 92 and 93 of the frame 86, and another buckle assembly 132 is mounted by rivets 129 or the like to each one of the linking runners 116 and 111 of the frame 107. Preferably, but optionally, a reinforcing plate 133 is associated at all locations of rivet 129 use.

Figure 8:
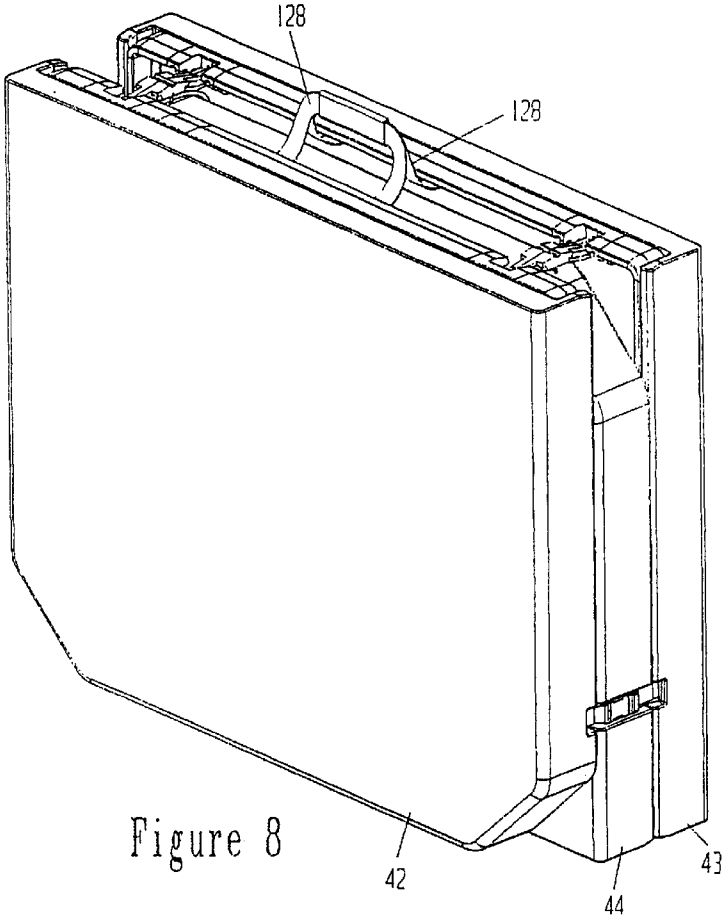
FIG. 8 is an isometric view of the FIG. 1 table in a fully disssembled and folded state.

To maintain the table 40 in its fully folded configuration as shown, for example, in FIGS. 8 and 9. The frame 107 of section 44 is provided on each of its longitudinal sides with a short closure strap 134 that has an associated terminal female buckle 136. Each closure strap is here mounted by rivets 129 or the like that extend through the base of each strap 134, through the adjacent end portion of the associated runners 117 and 118, and into the protruding connecting end portion of an associated outside corner block 119. Correspondingly, and in alignment with the closure straps 134 of frame 107, the frame 86 is provided on each of its longitudinal sides with a short closure strap 137 that has an associated terminal male buckle 135. Each closure strap 137 is here mounted by rivets 129 or the like that extend through the base of each strap 137, through the adjacent side wall of the associated runners 96 and 97, and into an insert 87 that has been slidably moved interiorly through each runner 96 and 97 so as to be in alignment with such rivets 129.

Component Structure: Hinges 55 through 58

Figure 24:
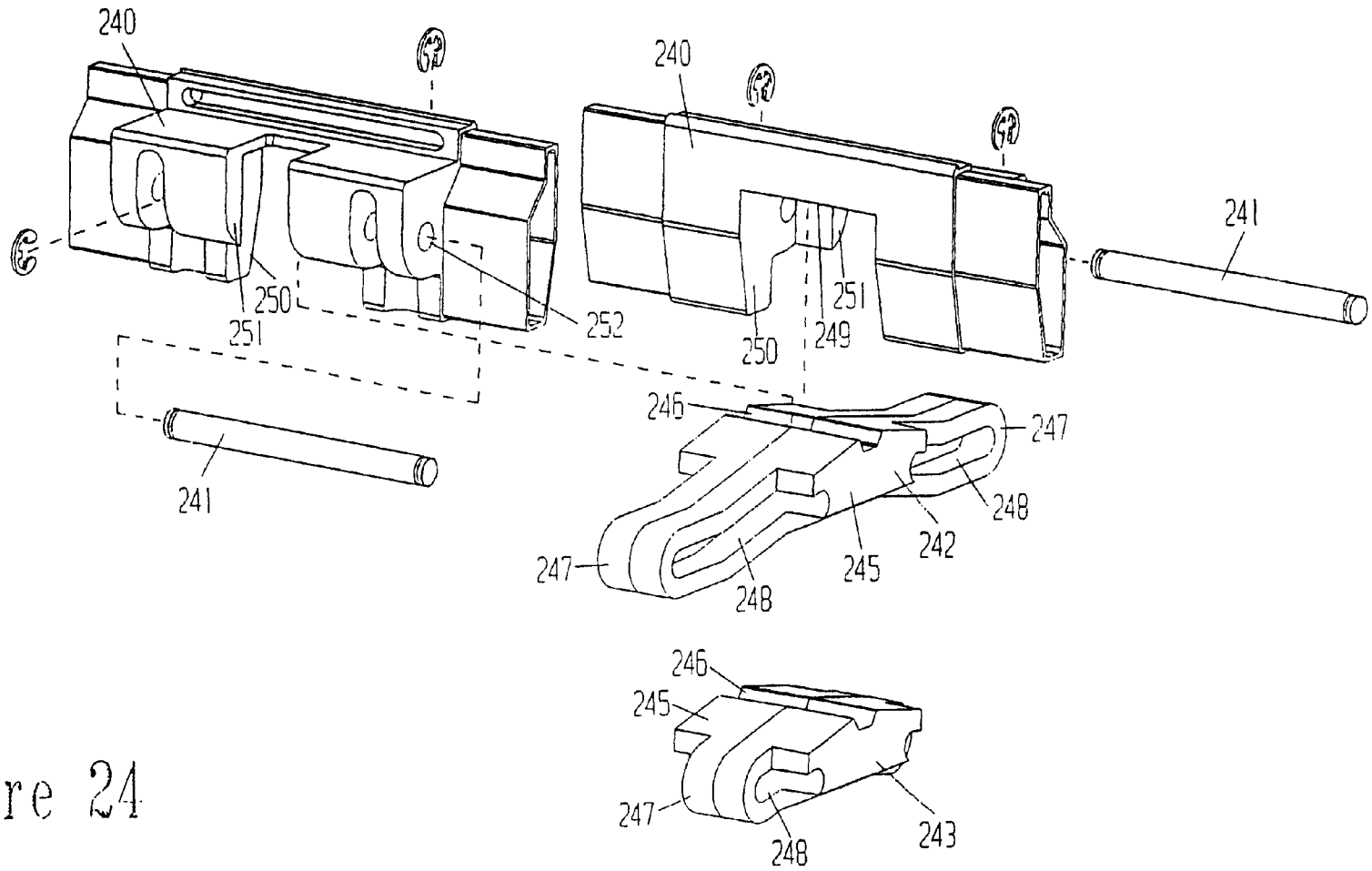
FIG. 24 is an isometric exploded view of one embodiment of a locking hinge assembly as employed in the FIG. 1 table.
Figure 25:
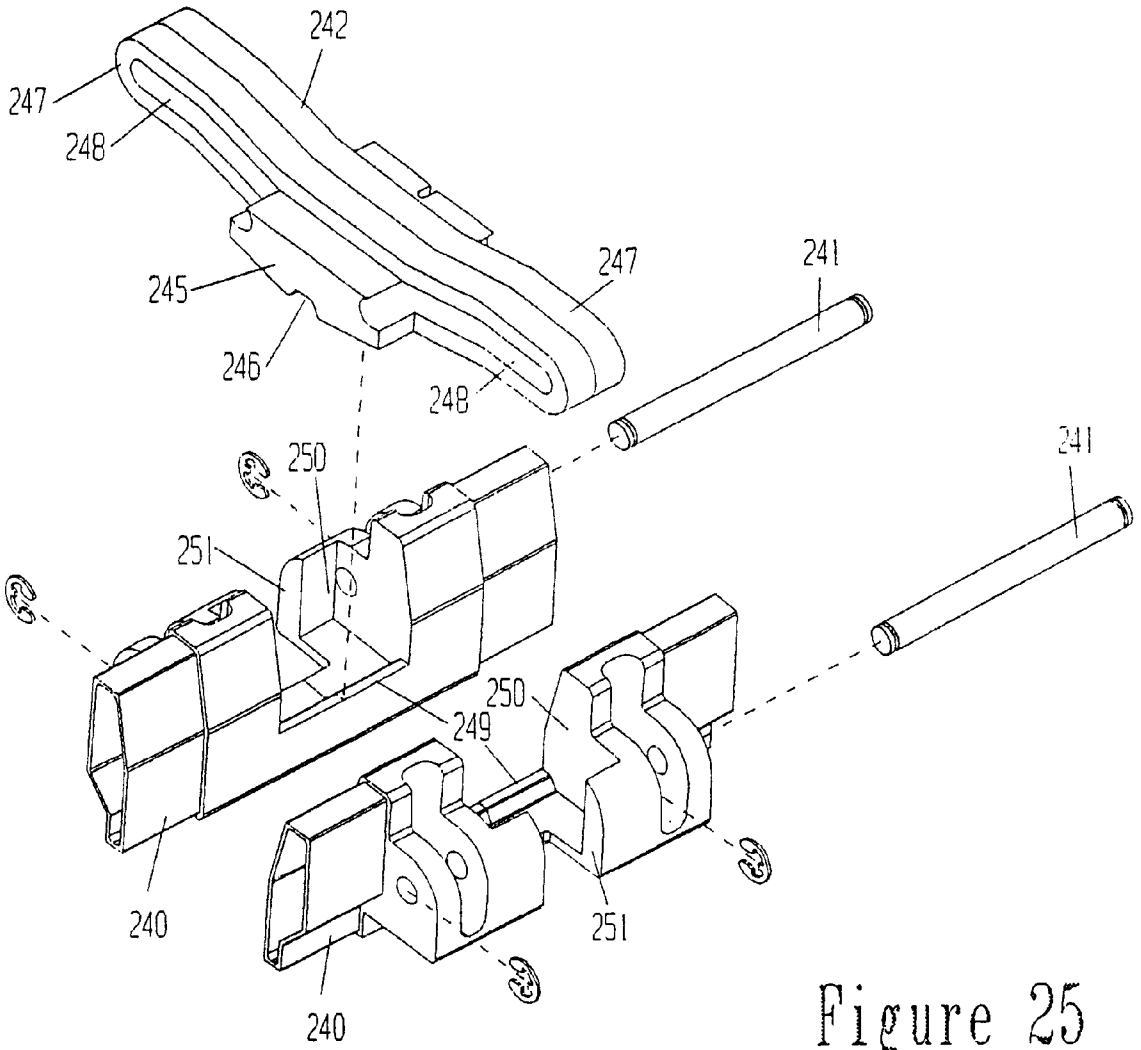
FIG. 25 is a view similar to FIG. 24 but showing the locking hinge assembly from another viewing perspective.

Hinge members 55, 56, 57 and 58 are here each preferably similarly constructed, as shown in FIGS. 24 and 25. Each such hinge has two identical opposing leaf members 240, each preferably being comprised of molded plastic or metal. Hinges 57 and 58 each incorporate a short hinge link member 243, and hinges 55 and 56 each incorporate a long hinge link member 242 both preferably comprised of molded plastic or metal. As described below each pair of leaf members is connected with its corresponding leaf member by two pintle members 241.

Both hinge link members 243 and 242 are similarly constructed so that each has a wide, horizontally aligned center section 245 that is inclined upwardly to an apex region that is defined by a horizontally aligned transversely extending center groove 246 defined across each link member 243 and 242. Extending at each opposite end of the center section 245 perpendicularly to the center groove 246 is a rounded guide section 247. Between the center section 245 and the terminal guide section 247 is an integral leg. The leg is short in link member 243 and elongated in link member 242. Between the guide section 247 and the center section 245 and extending through each opposite side of the leg a horizontally translating guide slot 248 is defined. Each hinge link member 242 and 243 is fitted to a pair of leaf members 240.

Each leaf member 240 contains an axially aligned medially located mouth opening 250 which accommodates the hinge link center section 245. Connected to the hinge leaf mouth 250 is an axially aligned hinge leaf throat 251 which accommodates the hinge link guide section 247. A horizontally aligned cylindrical bore 252 passes through the leaf member 240 at a location near the rear of the hinge leaf mouth. The hinge leaf 240 is fitted to its corresponding link member 242 or 243. A hinge pintle member 241 is inserted axially into the bore 252 of each leaf member 240 where it passes slidably through the link guide slot 248. When the opposing leaf member 240 is correspondingly and similarly fitted, the resulting hinge assembly has the assemble configuration shown in the lower views of FIG. 26A through 26D which illustrates the hinge members 55 and 56.

Figure 26A:
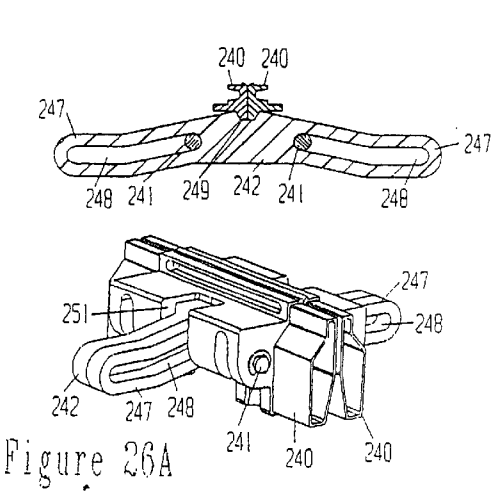
Figure 26B:
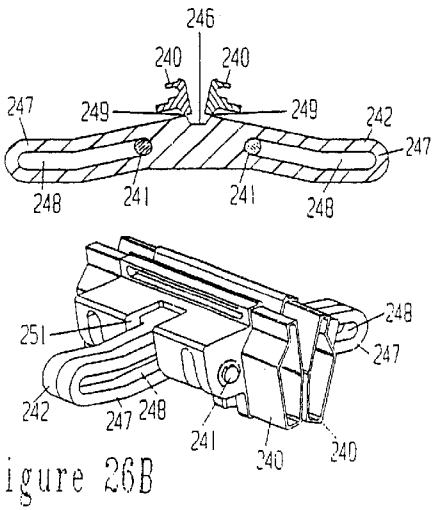
Figure 26C:
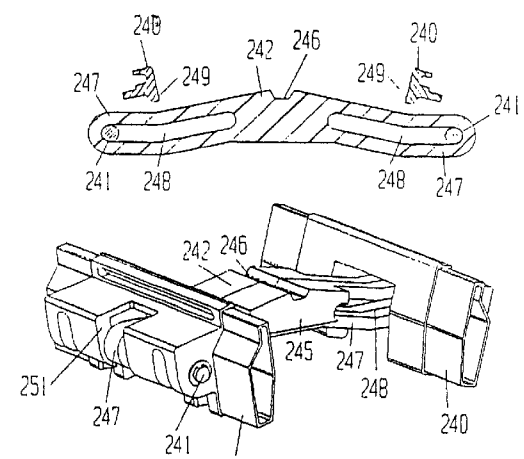
Figure 26D:
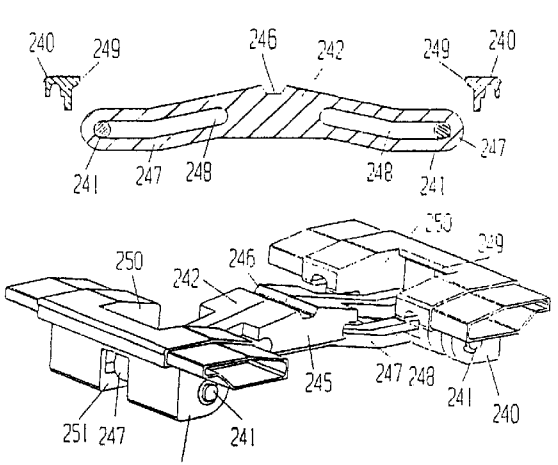

In each leaf member 240, the upper open end of the hinge leaf mouth 250 opposite the hinge leaf throat 251 is a horizontally aligned, vertically projecting hinge leaf tooth 249. Each opposing hinge leaf tooth 249 fits within half of the center groove 245 contained within the hinge link member 242. The interaction of these components is illustrated in the upper sectional views of FIGS. 24A through 24D. Thus, in the closed position illustrates in FIG. 24A, the three components are held axially by the opposing pair of hinge leaf tooth members 249 which bear against each hinge link member vertically through the hinge link member center groove 246. The leaf members 240 are restrained from horizontal motion and the hinge link center section 245 is restrained within the hinge leaf mouth 250. As the leaf members 240 are rotated open about the pintle members 241, the hinge leaf tooth members 249 retract from the hinge link center groove 246. This retraction allows the pintle members 241 to translate axially along the hinge link guide slot 248 as the leaf members 240 rotate about the pintle members 241. During this translation, the leaf members 249 are horizontally restrained because the hinge link guide is always partially in contact with the hinge leaf throat 251. In the fully open position, as illustrated in FIG. 26D, the leaf members become restrained axially by the hinge link guide section 247.

As illustrated in FIG. 24, the only variant in the hinge assembly is the axial length of the hinge link member guide section 247 which determines the overall open separation between the leaf members 240. By varying this length, similar components can be fabricated to accommodate various thicknesses of the table 40 section members.

Component Structure: Leg Pairs, Legs and Cross Braces

Each of the leg members 66A and 66B of leg pair 66, and each of the leg members 67A and 67B of leg pair 67 is similarly structured as are each of the cross braces 68A and 68B. The representative leg member 66A and its associated representative cross brace 68A are illustrated in FIGS. 15–21.

Leg member 66A incorporates a tubular lower leg section 148 whose upper end portion is telescopically and slidably received in the lower end portion of a tubular upper leg section 149. The lower end portion of lower leg section 148 is associated with a conventional elastomeric cushioning foot 151.

A retaining pin 183 is fitted into a vertically aligned aperture 182 near the end of a cylindrical spring body 178 containing a horizontally oriented center bore 179. A spring 177 is inserted into the opposite end of the horizontally aligned center bore 179 such that it abuts the retaining pin 183 which passes through the center bore 179, and the spring 177 is therefore contained within the center bore 179. This assembly is then inserted into the end of a cylindrical cross bar member 184. The cross bar member is provided with a pair of vertically aligned holes 185 near its end which are horizontally and rotationally aligned with a vertically aligned alot 186 further along its length. The spring body is positioned in the cross bar so that these apertures become concurrent with a pair of vertically aligned holes 180 and with a vertically aligned slot 181 in the spring body. At this point the cross bar is slidably inserted into a sleeve 173 defined in a cross bar catch 172. A retaining pin 176 is inserted into a vertically aligned hole 175 of the cross bar catch 172 and then passes through the aforementioned slots 186 and 181 such that it abuts the end of the spring 177 thus placing the spring between retaining pins 176 and 183.

The leg cable members 76 and 77 are configured so that one end of each forms a loop made using a cable end crimp-type fastener 81. These loops which are large enough to be placed over the cross bar member 184 are inserted into a vertically aligned opening 164 defined in a slide 181. The cross bar member 184 is then inserted into a horizontally aligned sleeve 163 defined in the slide 161, through the loops in cables 76 and, 77 and into the inner end of sleeve 163 which passes through the opening 164. A pair of roll pins 166 are then inserted into a pair of vertically aligned holes 165 defined in the slide 161 which are then concurrent with the aforementioned pairs of holes 180 and 185. Thus, the leg cable members 76 and 77 are connected to the cross bar by the slide 161 and the spring body 178 that is contained within the cross bar 184 and the slide 161 and are fastened to the cross bar 184 by the retaining pin pair 166. Further the cross bar catch 172 is allowed to translate horizontally on the cross bar but is limited in travel and held in rotational position by the retaining pin 176 contained within the slots 188 and 181 and is returned to an outboard position by the spring 177 which pushes against the slidable pin 176 and the static pin 183. This relationship can be seen in FIGS. 19–21.

An upper leg section 149 is slidably inserted into a vertically aligned sleeve 162 defined in the slide 161. The lower end of the upper leg section 149 is then fitted with an upper leg base 167. The upper leg base 167 is preferably comprised of molded plastic and contains an imbedded, horizontally aligned, outwardly extending pin 168 that is preferably comprised of steel. This pin 168 is designed for fitment with a horizontally aligned well or pocket 174 contained within the cross bar catch 172 as described later. The upper leg section 149 is fitted to a vertically aligned counterbore 169 defined in the upper leg base 167. The counterbore 169 region is such that the lower leg section 148 can be slidably extended therethrough.

Figure 18:
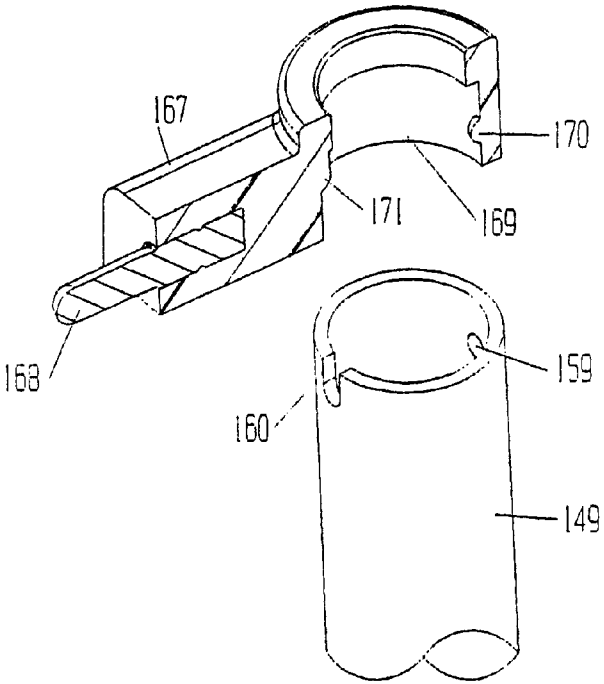
FIG. 18 is a fragmentary isometric exploded view of the leg assembly of FIG. 15 showing the relationship between the upper leg and the upper leg base of FIGS. 5, 16 and 17 with the latter being shown in longitudinal section.
Figure 16:
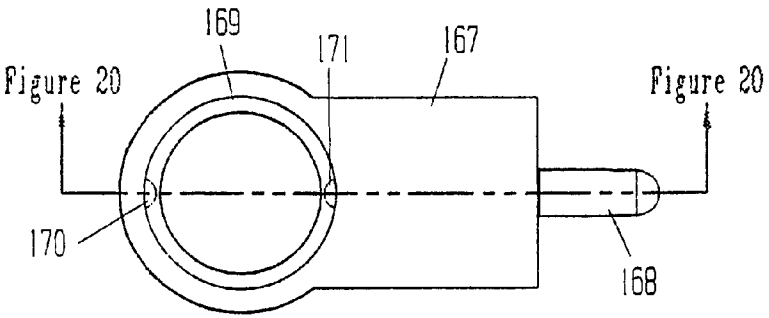
FIG. 16 is a top plan view of the upper leg base employed in the leg assembly of FIG. 15.
Figure 17:
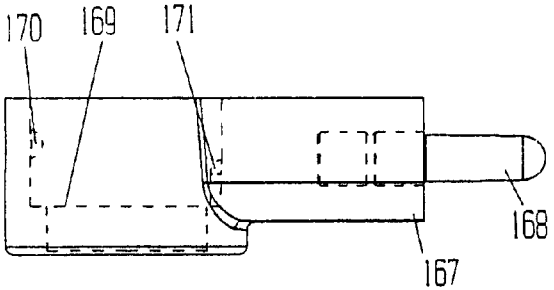
FIG. 17 is a side elevational view of the upper leg base of FIG. 1.

The upper leg base 167 is maintained in a fixed orientation when engaged with the upper leg section 149. For this purpose, various means can be employed. Preferably and as shown in FIGS. 18–20, a horizontally aligned hole 159 is provided in the upper leg section 149 adjacent its lower end, and a vertically aligned notch 171 is defined adjacent its lower end and opposite the hole 159. Also, a hemispherically configured protrusion 170 is integrally formed in the counterbore 169 of upper leg base 167, and, opposite the protrusion 170, a horizontally aligned longitudinally extending finger-shaped protrusion 171 is formed. The relationship between the hole 159 and the notch 160 in the upper leg section 149 and both protrusions 170 and 171 is such that, when the counterbore of the upper leg base 167 is fitted over the end of the upper leg section 149, the protrusion 170 engages the hole 159 and the protrusion 171 engages the notch 160, thereby fixing and orienting the upper leg base 167 to the upper leg section 149.

Referring back to FIG. 15, a detent pin 154 that is fitted to a spring 153 is inserted into the upper end of the lower leg section 148 such that the pin 154 can protrude from and be depressed into a horizontally aligned hole 155 near the upper end of the lower leg section 148. This assembly is then slidably inserted through the counterbore 169 of upper leg base 167 and into the lower end of upper leg section 149. In order for the leg assembly to telescope, the upper leg section 149 contains a vertically spaced series of horizontally aligned holes 158. The pin 154 pushed outward by its spring 153 engages these holes and thus holds the lower leg section 148 in the desired position relative to the upper leg section 149.

The upper leg section 149 is fitted with a cap 151 containing a horizontally aligned hole 156 which aligns with another horizontally aligned hole 157 contained in the upper leg section 149 near its upper end. A pin member 152 is used within these holes to fasten the leg assembly to the leg connector assembly 69 as described below.

FIGS. 19 through 21 illustrate the function of the above-described leg and cross bar assembly as it relates to releasing the tension in leg cable members 76 and 77. The cable members themselves are not shown in these view and the lower leg section 148 is shown in its retracted position as the cross bar slide 161 can be prohibited from upward motion by the leg detent pin 154 when the lower leg section 148 is in an extended position.

In the closed position as shown in FIGS. 19A and 19B, the cross bar assembly 68*a* or 68*b* as described above is prohibited from motion as a pair of pins 168 is engaged with a pair of cross bar catches 172 through a pair of pockets 174 as described above. The cross bar catches 172 are held in position with the pins 168 by the springs 177 as described above. In this configuration, the assembly is not allowed to slide upward as forces resolve through upper leg members 149 via the upper leg bases 167 and cross bar catches 172.

Figure 21A:
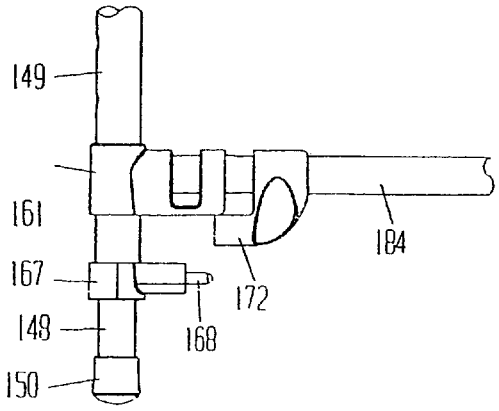
FIG. 21A and FIG. 21B are similar to FIG. 20A and FIG. 20B, respectively, except that the upper leg base is separated from the upper leg base.
Figure 21B:
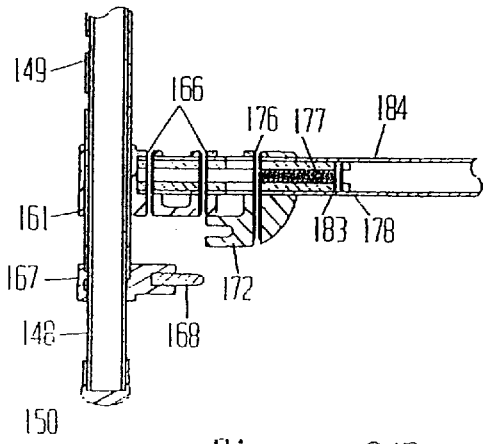
Figure 22:
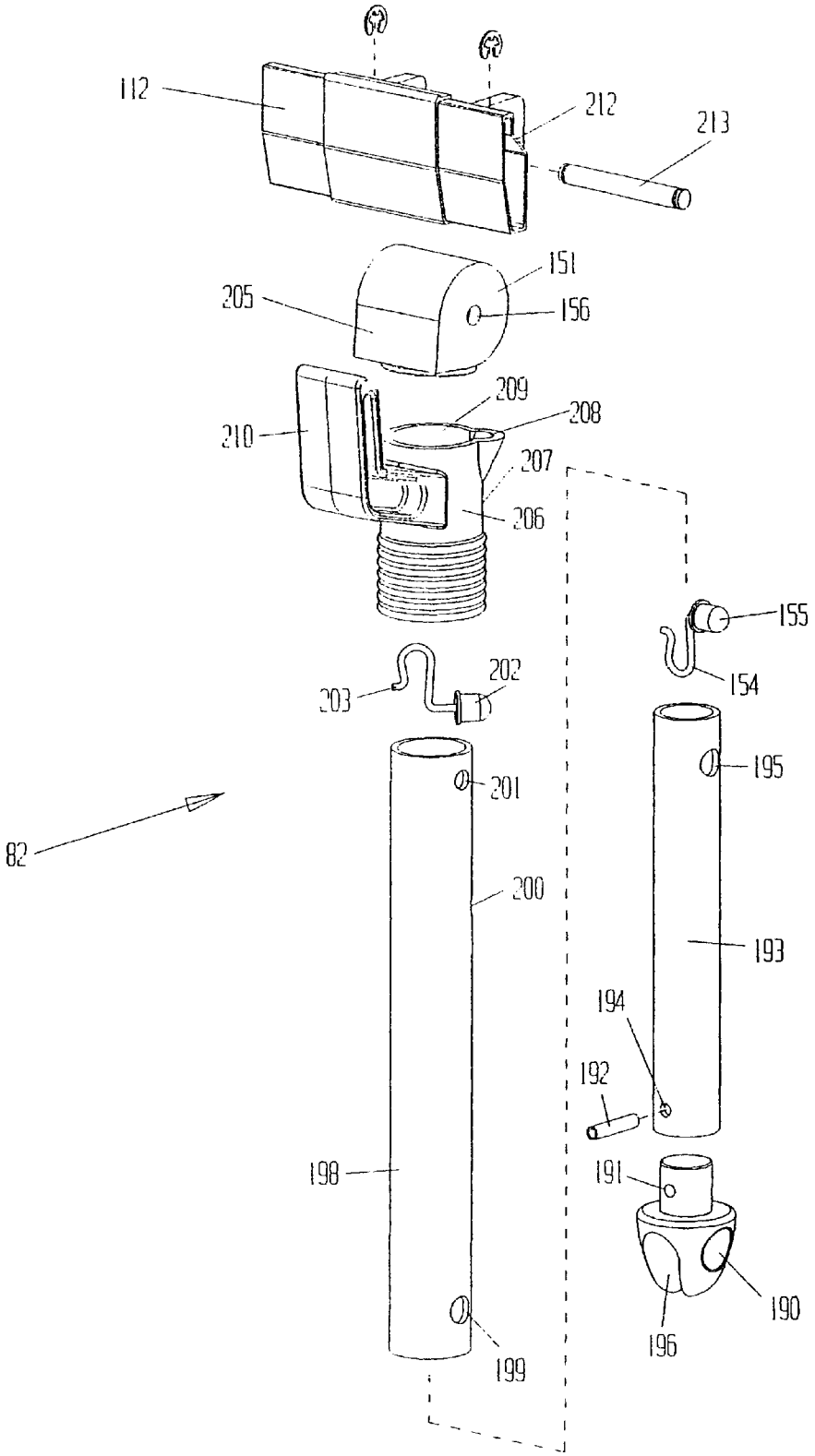
FIG. 22 is an exploded view of a platform-to-cable load transfer bar (or a truss leg) and section catch assembly.

FIGS. 21A and 21B shows one cross bar catch as it would appear if manually disengaged by pushing against the spring 177 to disengage the cross bar catch 172 from the pin 168. As each pair of these members is simultaneously disengaged, the assembly 68*a* or 68*b* is free to slide upward along the upper leg 149 resulting in the configuration shown in FIG. 21A and 21B where tension is released from cable members 76 and 77, thus allowing the corresponding leg pairs to rotate to their closed position.

The Load Transfer Bars and Panel Catch Assemblies 82 and 83

Each of the load transfer bars 82 and 83 has a similar structure. The structure of bar 82 and its associated pivot member or hinge 112 (seen in FIG. 13) and panel catch member 206 are illustrated in FIG. 13.

A cable guide member 190 containing a cable receiving groove 196 is fitted to the lower end of a lower bar member 193 and is fastened with a retaining pin 192. Pin 192 is received by a horizontally aligned hole 194 that is near the lower edge of the lower bar member 193, and that is concentric with a horizontally aligned hole 191 contained within the cable guide member 190. Preferably, for manufacturing cost purposes, the upper and lower load transfer bar members 193 and 198 are constructed of the same tubular material as the upper and lower leg members 148 and 149. Thus, the same detent pin and spring members 155 and 154, respectively, are conveniently used in the construction of the load transfer bars 82 and 83. The detent pin 154 fitted to a spring 153 is inserted into the upper end of the lower bar section 193 so that the pin 154 can protrude from and be depressed into a horizontally aligned hole 195 near the upper end of the lower bar section 193. This subassembly is then slidably inserted into the lower end of upper bar section 198. In order for the bar assembly to telescope, the upper bar section 198 contains a horizontally aligned hole 199. The pin 154 when pushed outwardly by its spring 153 engages this hole and thus can be used to hold the lower bar section 193 in the desired position relative to upper bar section 198. The upper end of the upper bar member 198 is then slidably inserted into a sleeve 209 defined in a panel catch member 206. A second detent pin member 202 is fitted to a spring 203 and is fitted into the upper end of upper bar member 198 so that the pin 202 can protrude from and be depressed into a horizontally aligned hole 200 (partially shown) near the upper end of the upper bar section 198. The upper bar section 198 is then fitted with a cap 151 containing a horizontally aligned hole 156 which aligns with another horizontally aligned hole 201 contained in the upper bar section 198 near its upper end. A pin member 213 is then used within these holes to fasten the bar assembly to the bar pivot member 112 through a horizontally aligned hole 212 (seen in FIG. 13) contained within the bar pivot member 112. The upper bar cap 151 contains a flat face 205 designed to rest against the inside of its pivot member 112, thus restraining rotational motion and holding the load transfer bar open in an inboard canted direction. Once the bar assembly is folded to its open position, the platform cable member, in this case 78, is engaged with the notch 196 of the cable guide 190 as described above. The lower bar 193 is then extended and locked into place via the pin 155 and spring 154 as described above. The cable member is adjusted, by means described later, so that in this configuration it is under slight tension. The open geometry of the load transfer bar and panel cable member are such that, for the load transfer bar to rotate, closed or outboard movement is restrained by the section cable member. This can be seen in FIG. 3, for example.

Figure 23:
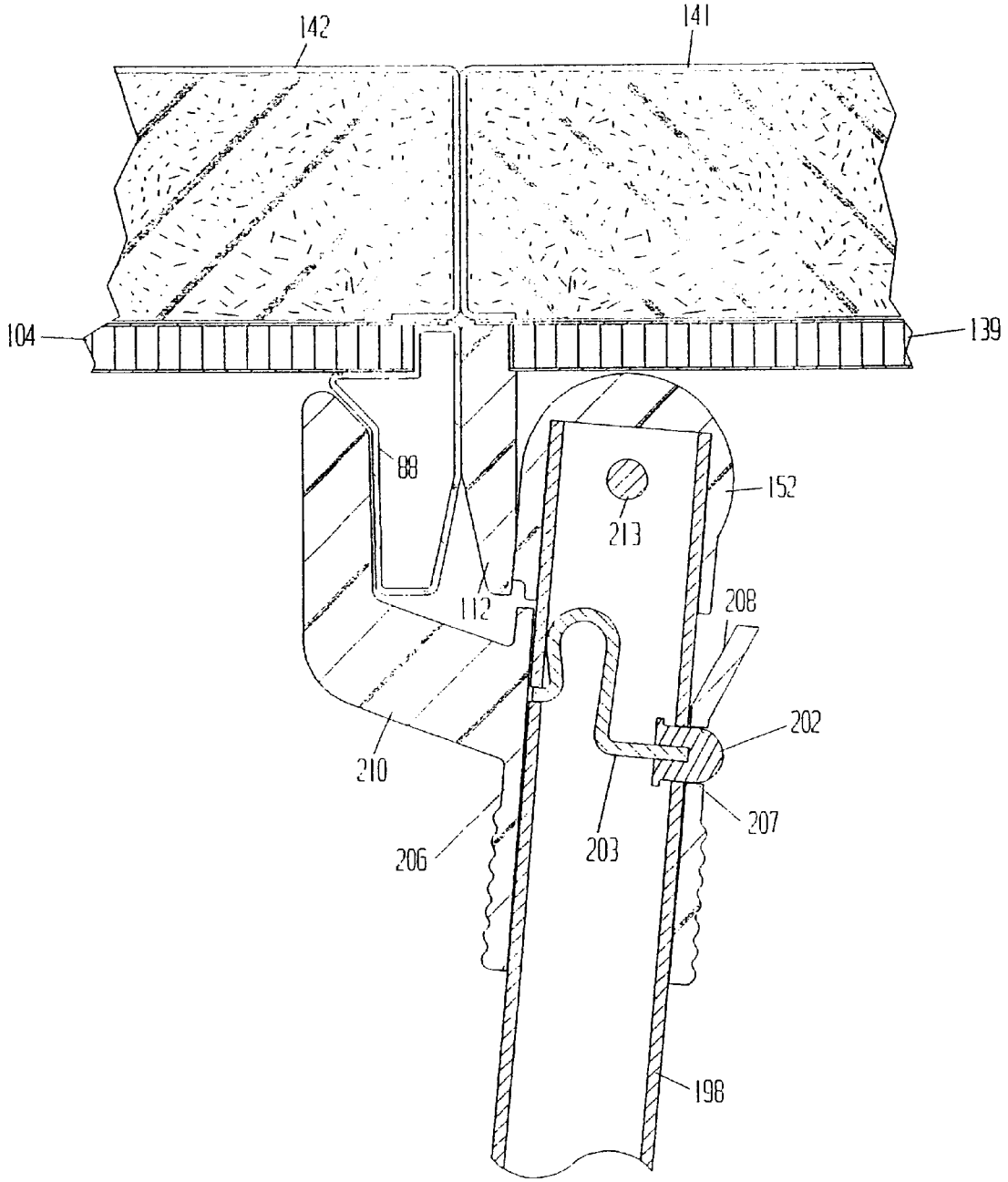
FIG. 23 is a fragmentary vertical sectional view taken longitudinally and axially through the section catch assembly of FIG. 22 while in erected association with the FIG. 1 table.

Once the load transfer bar is open as described above, the section catch member 206 is slid upwards along the upper bar member 198. The section catch member 206 contains a funnel shaped protrusion 208 designed to accept the exposed volume of detent pin member 202 and automatically depress the pin as the panel catch member 206 is slid upwards. After the detent pin is depressed, it is then allowed to protrude from a horizontally aligned hole 207 (partially shown) contained within the panel catch member 206 that is vertically aligned with and just below the funnel shaped protrusion 208. This arrangement locks the section catch member 206 in its upward position. The purpose of the section catch member 206 is to provide some means of interconnecting the end and center panel members in the event the table when unloaded is lifted for repositioning. The hinge members 55–57 as described herein articulate and separate for table folding and support downward forces when the table is in use, but any upward or lifting forces on the center panel member 43 will cause the hinges to open. The section catch member 206 employs an arm 210 which serves as a lever to act against the panel frame member opposite the load transfer bar, in this case runner section 88 of frame member 86 as is seen in FIG. 23, thus holding the hinges closed against the load transfer bar 82 and through the panel cable member 78.

The Leg Pairs, Legs and Cross Braces

Each of the leg members 66A and 66B of the leg pair 66, and each of the leg members 67A and 67B of this leg pair 67 is similarly structured as are each of the cross braces 68A and 68B. The representative leg member 66A and its associated representative cross brace 68A are illustrated in FIGS. 15–21.

Leg member 66A incorporates a tubular lower leg section 148 whose upper end portion is telescopically and slidably received in the lower end portion of a tubular upper leg section 148. The lower end portion of lower leg section 88 is associated with a conventional elastomeric cushioning foot 151.

The section pads 141, 142, 143 are conveniently and preferably constructed of an upholstered molded foam material shaped such that the geometry of the pads does not interfere with the articulation of the section members. These pads are conveniently fastened to the section top surfaces with a removable attachment means, such as a hook and loop (e.g., "Velcro" type) fastener, a double stick foam attachment tape such as used in the automotive industry, or the like. Allowing these pads to be removed for cleaning or replacement after damage or wear is a feature not currently common on any folding padded tables.

Section Cable Members

Each of the platform cable members is fixed at one table platform end and is adjustable in length at its opposite table platform end. FIGS. 27 through 30 show both fitments of the platform cable member 78 to the cable mounting bracket 123 (described above). The fitment shown is for cable 78 and is exemplary of the fitment of cable 79.

Figure 29:
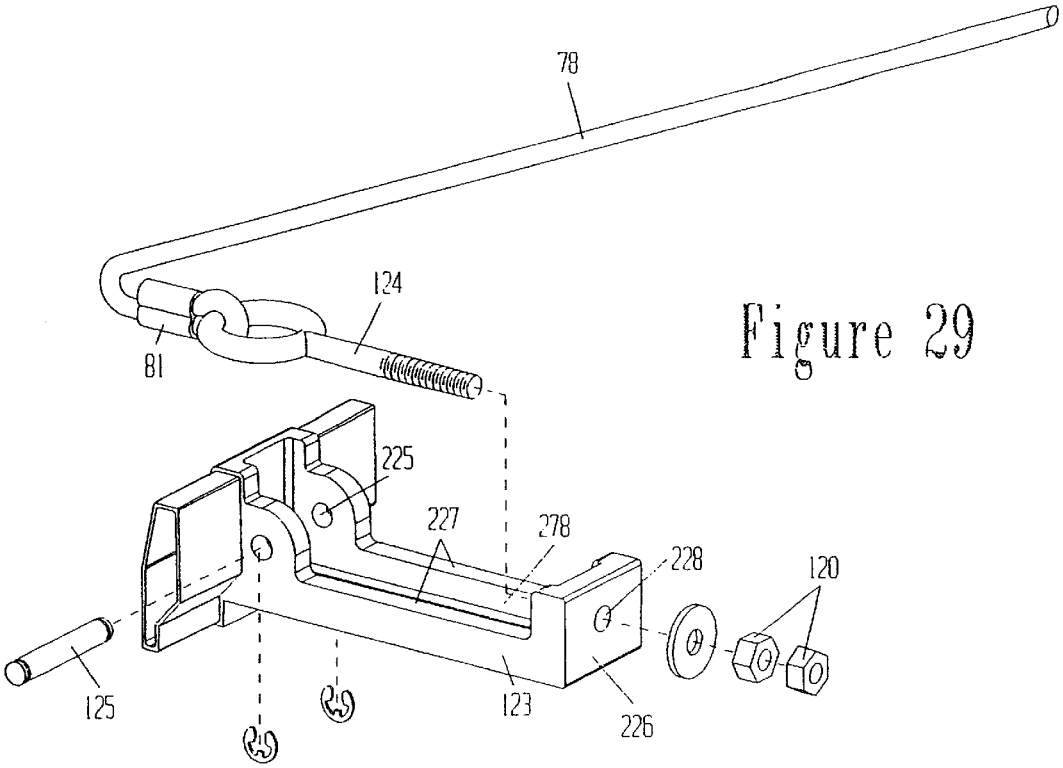
FIG. 29 is an exploded view of the cable fitment of the tensioned opposite end of one load bearing cable (here cable 78) which end opposite to the end of the load bearing cable shown in FIG. 27.

As is seen is FIG. 29, the cable mounting bracket 123 here has an axially aligned cable channel 278 which has a trough shape with a horizontally aligned cylindrical bore 225 passing through its vertical walls and open to the channel near the end vertical wall of the channel which defines a portion of a section frame member as described above. Channel 278 is also opposite the vertical horizontally aligned end wall of the cable channel 278 that defines a horizontally aligned, flat, vertical face 226. The face 226 contains an axially aligned hole 228. The axially aligned walls of the cable channel 278 each have a flat, axially aligned, horizontal guide rail section 227.

Figure 27:
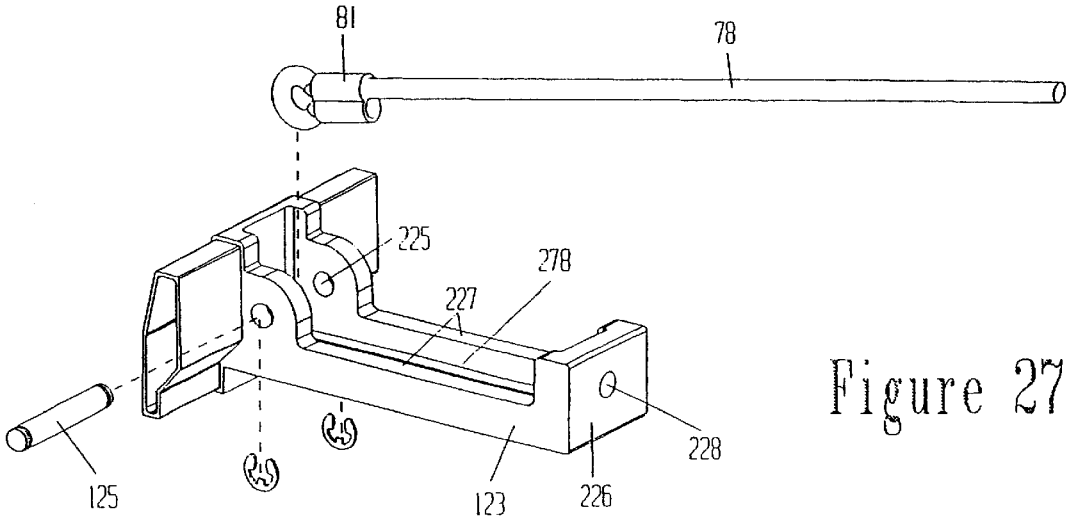
FIG. 27 is an exploded view of the cable fitment of the non-tensioned and disassembled end of one load bearing cable number, (here illustrating the non-tensioned end of load bearing cable 78)
Figure 28:
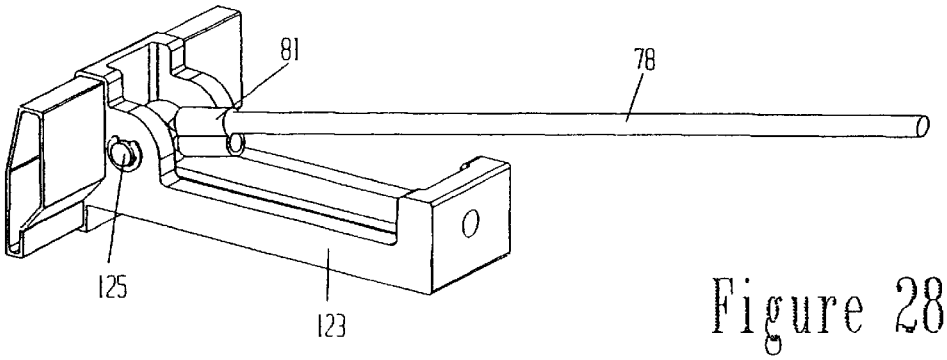
FIG. 28 is an assembled and table erected view of the components shown in FIG. 28.

The fitment of the fixed end of the platform cable member is illustrated in FIGS. 27 and 28 and employs a cable clamp 81. The end of the cable member 78 is formed into a loop large enough to accept a pintle member 125. This looped cable end is positioned within the axially aligned walls of the cable channel 278 and the pintle 125 is fitted diametrically into the cylindrical bore 225 where it passes through the loop in cable member 78 thus connecting the cable member 78 to the cable mounting bracket 123, as illustrated in FIG. 28, which becomes an integral component of the section members (described above).

Figure 30:
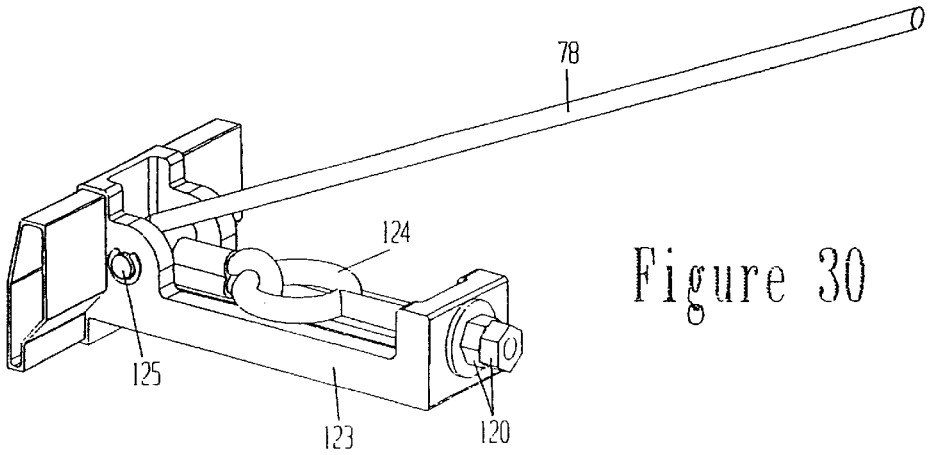
FIG. 30 is an assembled and table erected view of the component shown in FIG. 29.

The fitment of the adjustable end of the platform cable member is illustrated in FIGS. 29 and 30. A cable clamp 81 is used at the end of the cable member and is fastened to a threaded cable tensioning screw 124. The tensioning screw is fitted into the cable mounting bracket 123 through the hold 228 (described above) such that the tensioning screw is restrained in axial rotation by the horizontal guide rail section 227 and is axially adjustable by a pair of hex nuts 120 or the like acting against the flat vertical face 226. In this fitment, the platform cable member is redirected axially around the pintle member 125 which is fitted into the bore 225 (described above). This configuration allows the cable member to connect vertically with the platform member via the pintle member 125 and be changed in length by adjustment of the tensioning screw 124.

Leg End Connector Assemblies 69

Figure 31:
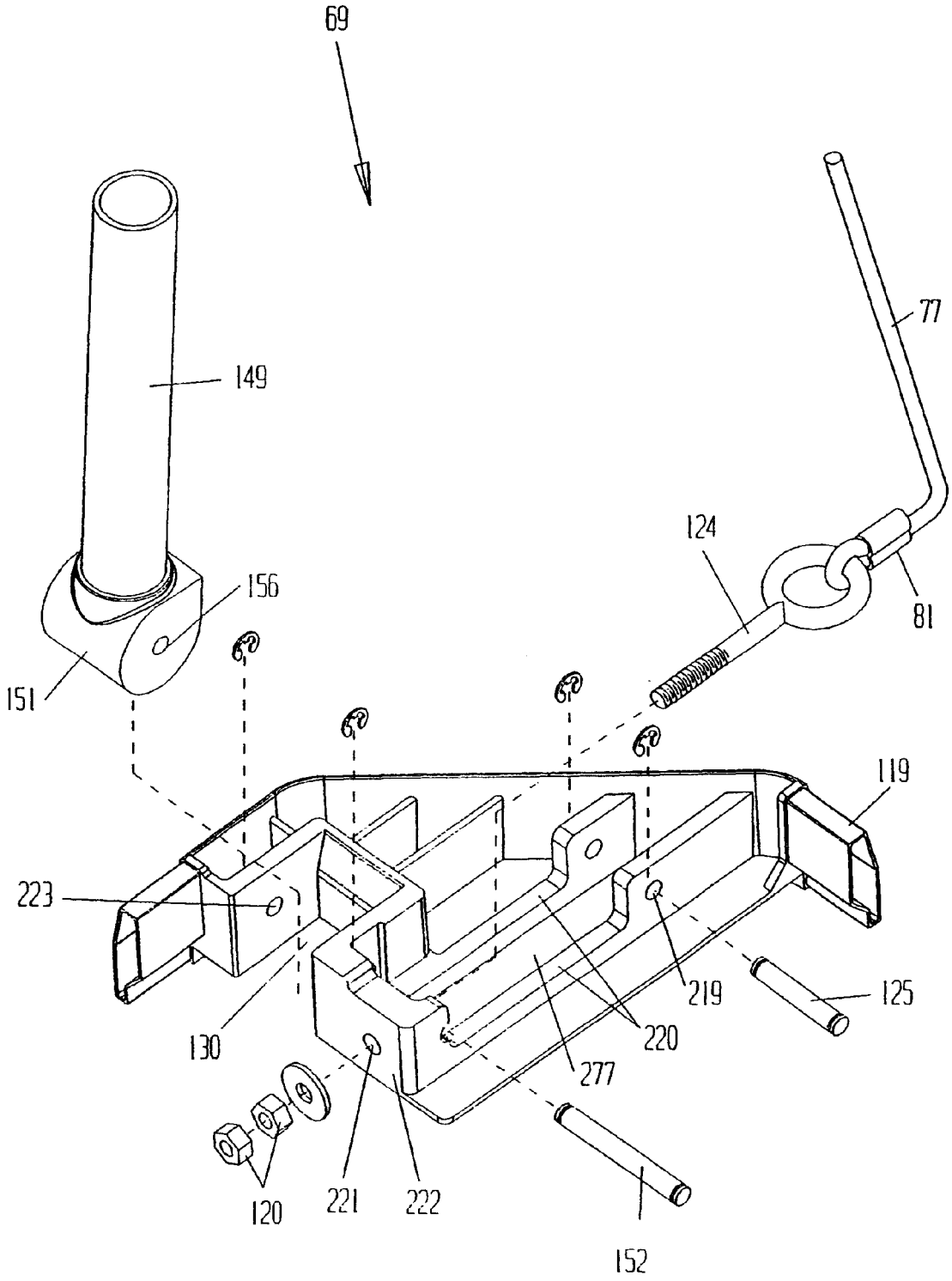
FIG. 31 is an exploded view of the cable fitment of another leg cable member (here illustratively cable 77) and of the fitment of individual leg members into an end section frame corner block.
Figure 32:
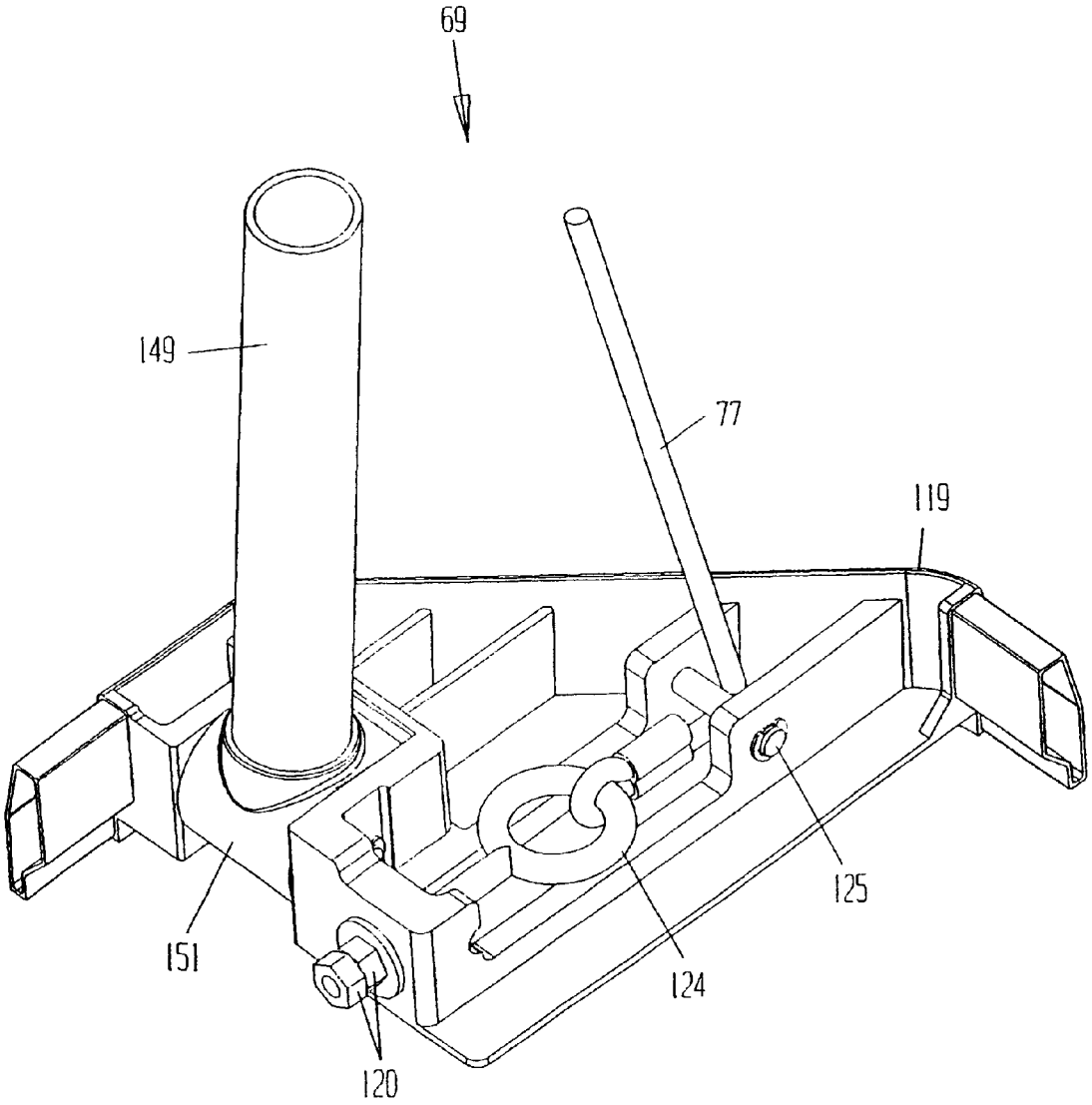
FIG. 32 is an assembled view of the components shown in FIG. 31.

FIGS. 31 and 32 illustrate the fitment of each of the leg cable members 77 to the leg end connector assembly 69 (described above). A corner block 119 (described above) contains an axially aligned socket 130 with a horizontally aligned cylindrical bore 223 passing therethrough. The socket accepts the upper leg end cap 151 (described above), and the leg pintle member 152 is inserted diametrically into the bore and through the bones 156 in the upper leg cap and 157 in the upper leg section 149 (described above), thus connecting the leg member, in this instance 66A, to its panel member.

The outside corner block 119, described above, also contains a cable channel 277, defined with a horizontally aligned bore 219, a pair of horizontal guide rails 220, an axially aligned hole 221, and a vertical face 222, all of which are identical in orientation and function to the similarly named features of the cable mounting bracket 123 (described above). The leg cable member 77 is attached to a tensioning screw 124 using a cable clamp 81 and is fitted to the cable channel 277 using a pair of hex nuts 120 or the like and is then redirected via pintle member 125 which is identical in function to the fitment of cable member 78 (described above) except member 125 is in this case tensioning both leg cable members as the axial motion of the upper end of leg cable member 77 translates into leg member rotation which in turn tensions leg cable member 76.

Leg Cable Members 76

Figure 33:
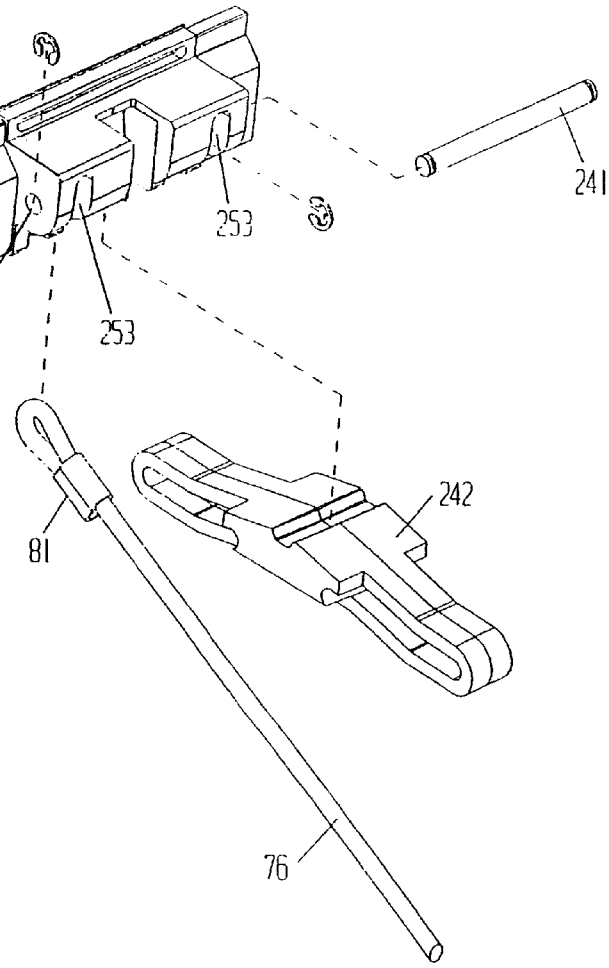
FIG. 33 is an exploded view of the cable fitment of the opposite end of the leg cable member shown in FIG. 31 and associated hinge leaf member.
Figure 34:
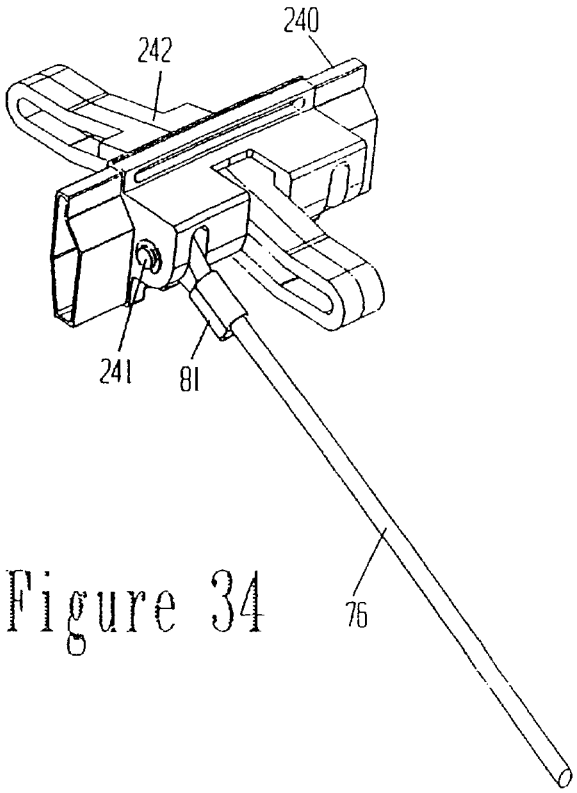
FIG. 34 is an assembled view of the components shown in FIG. 33.

The fitment of each leg cable member 76 to a table panel member via a hinge leaf member is shown in FIGS. 33 and 34. The leaf member 240 (described above) is further defined with a vertically aligned cable receiving groove 253 which is passed through by the cylindrical bore 252 (described above). The leg cable member 76 is formed into a terminal loop large enough to be passed through by the hinge pintle member 241 at one end by a cable clamp 81 and is fitted into the cable receiving groove 253 before the hinge pintle member 241 is installed (described above). Thus the inner end of the leg cable member 76 is fastened to its corresponding frame member (described above).

While this is the preferred configuration for this assembly, a similar groove and bore may be implemented in any of the end section frame members to achieve other configurations.

The foregoing illustrates the general principles of this invention. However, since numerous modifications and changes will be readily apparent to those skilled in the art based on this description, it is not desired to limit the invention to the exact construction and operation shown and described. Accordingly, the scope of this invention includes other modifications and equivalents that fall within the scope of the foregoing description and the following claims.

What is claimed is:

1. A folding table comprising in combination:

(A) a platform that has a flat configuration and also a folded configuration, said platform being defined by three generally flattened sections arranged in adjacent, successive relationship relative to one another so as to define first and second end sections that each have one side adjacent a different opposed side of a central section;

(B) first hinge means for pivotally interconnecting said first end section to said central section and second hinge means for pivotally interconnecting said second end section to said central section, the interrelationship between said sections and said first and said second hinge means being such that when said platform is in said folded configuration, said first end section is folded back upon said central section in adjacent relationship, and said second end section is folded back upon said central section over said first end section;

(C) two pairs of leg members for supporting said platform when said platform is in said flat configuration, each said pair including (1) interconnecting rigid cross brace means extending between said leg members of each said pair, (2) connection means for pivotably connecting upper end portions of each one of said pairs with a different one of each of said first and second end sections, and (3) cable bracing means extending between each said pair and said so connected one of said end sections for holding said leg means in a platform supporting position when said platform is in said flat configuration;

(D) a pair of elongated cable members including cable end mounting means for supporting said platform in said flat configuration, each said elongated cable member having each opposite end thereof joined to a location on a different one of said first and said second end sections, each said elongated cable member being positioned so as to extend along a different longitudinally extending side region of said platform when said platform is in said flat configuration; and (E) two platform-to-cable load transfer bars, each bar extending between a different one section and a different one of said elongated cable members for tensioning each said so engaged cable member when said platform is in said flat configuration.

2. The folding table of claim 1 wherein each said load transfer bar is pivotably joined to said section from which it so extends.

3. The folding table of claim 1 wherein each of said first and said second hinge means includes releasable locking means for retaining said platform in said flat configuration.

4. The folding table of claim 1 wherein each one of said load transfer bars is pivotally joined to said position, said position for each said load transfer bar being on a different one of said first and said second end sections.

5. The folding table of claim 4 wherein said position is adjacent the interior side of each respective one of said end sections.

6. The folding table of claim 1 wherein each said section comprises a generally flat panel having a perimeter that includes at least one pair of spaced, opposed sides and a frame structure that extends about said perimeter, said frame structure including an inwardly extending shoulder defined therealong for supporting perimeter portions of said panel when said frame structure and said panel are horizontally extended, said frame structure being comprised of a plurality of interfitting components.

7. The folding table of claim 6 wherein along one of said spaced, opposed sides said interfitting components define in spaced relationship to each other a pair of hinge leaves.

8. A folding table comprising in combination:

(A) a platform that has a flat configuration when said table is unfolded and that has a folded configuration when said table is folded, said platform being defined by three generally flattened sections arranged in adjacent, successive relationship relative to one another so as to define first and second end sections that each have one side adjacent a different opposed side of a central section;

(B) first hinge means for pivotally interconnecting said first end section to said central section;

(C) second hinge means for pivotally interconnecting said second end section to said central section, said second hinge means additionally including means for longitudinally extending said second end section relative to said central section so that, when said platform is in said folded configuration, said first end section is folded back upon said central section in adjacent relationship, and said second end section is folded back upon said central section over said first end section;

(D) two pairs of supporting leg means for said platform when said platform is in said flat configuration, each said pair including:

(1) interconnecting rigid cross brace means extending between said supporting leg means of each said pair, (2) connection means for pivotably connecting upper end portions of each one of said pairs with a different one of each of said first and second end sections, and (3) cable bracing means extending from a location adjacent each one of said supporting leg means and such so connected one end section for holding said supporting leg means in a generally upright, platform supporting position when said platform is in said flat configuration;

(E) a pair of elongated cable members for supporting said platform in said flat configuration, each said elongated cable member having each opposite end thereof joined to a location on a different one of said first and said second end sections, each said elongated cable member being positioned so as to extend beneath and adjacent to a different respective opposite longitudinally extending side region of said flat working platform when said platform is in said flat configuration and each said elongated cable member including means for joining said opposite ends to said respective end section locations, each said cable member so having a length that is greater than the distance between said respective locations on each of said end sections when said platform is in said flat configuration; and (F) two platform-to-cable load transfer bars, each said bar being pivotally joined to a position on at least one of said sections, and each said bar having an outer end positioned and configured for resting engagement with a different one of said cable members when said leg means are in said upright, platform supporting position with said platform being in said flat configuration, thereby tensioning each said so engaged cable member;

whereby, when said platform is in said flat configuration, and a load is placed thereon, the weight of said load is transferred through said load transfer bars to said elongated cable members and said elongated cable members support said load.

9. The folding table of claim 8 wherein each of said means for joining is located adjacent to a different outside end of said respective end section location.

10. The folding table of claim 8 wherein each of said supporting leg means is so held by two said cable bracing means.

11. The folding table of claim 10 wherein, for each of said supporting leg means, each of said cable bracing means has one end thereof fixed to an adjacent interconnecting end portion of said cross brace means, one of said cable bracing means has the opposite end thereof fixed to the associated said end section adjacent to the interior side thereof, and the other of said cable bracing means has the opposite end thereof fixed to said connection means for said supporting leg means.

12. The folding table of claim 8 wherein each of said sections includes a frame means that extends about the perimeter thereof and a panel means that is supported by said frame means.

13. A hinge comprising in combination:

a pair of leaf members, each said leaf member including means for mounting at a different one edge portion of a pair of adjacent sections that are pivotably movable relative to each other about an axis extending along and between said edge portions;

a link member having:

a central region having opposed lateral end portions, spaced parallel opposed side faces, and opposed top and bottom surface portions, said top surface portions having a groove with opposed lateral sides transversely extending thereacross, and said top surface portions having flat downwardly inclined symmetrical portions on each one of the lateral sides thereof, and a pair of opposed legs, each said leg outwardly extending from a different one of said opposed lateral end portions of said central section, each said leg having spaced, parallel, opposed side walls, top and bottom surface portions, and rounded opposite end portions extending between said top and bottom surface portions, each said leg having a laterally elongated, transversely extending channel defined through said side walls, said top surface portions of each said leg including an initial downward inclination that is contiguous with and extends from said top surface portions of said central region;

each said leaf member further including a central, upwardly extending, thickened platform portion and a medially located mouth opening defined transversely through said leaf member and said platform member, said platform portion having a bore defined therein; and each said leg member being positioned in a different one of said mouth openings;

and a pair of pintle members, each one of said pintle members extending through a different one of said leg channels and said platform portion bores whereby each said leaf member is translatably and pivotably mounted to a different one of said leg members;

the relationship between said leaf members, said link member and said pintle members being such that:

(a) when said leaf members are in adjacent side by side relationship, said hinge is in its fully closed position, each said pintle member is located at one end of the associated said leg channel adjacent to said central region, and an edge portion of each said leaf member is located in said groove, and (b) when said leaf members are in maximally spaced separated relationship, said hinge is in its fully open position, each of said pintle members is located at an opposite end of the associated said leg channel remote relative to said central region, and (c) when said leaf members are being opened from said fully closed position to said fully open position portions, each said leaf member slidably moves over said top surface portions and said rounded opposite end portions of said legs.

14. The hinge of claim 13 wherein said means for mounting each one of said leaf members comprises a cavity defined at each end of each leaf member, each said cavity being configured for receipt of a terminating projection of a frame component.

15. A section for use in a combination of sections that are arranged in adjacent and successive relationship to one another so as to define a platform, said section comprising:

a generally flat panel having a perimeter that includes at least one pair of spaced, opposed sides, and a frame structure extending about said perimeter, said frame structure including an inwardly extending shoulder defined therealong for supporting perimeter adjacent portions of said panel when said frame structure and said panel are horizontally oriented;

said frame structure being comprised of a plurality of interfitting components that are longitudinally adjacent to one another relative to said frame structure;

each said component having a pair of opposite end portions, each said end portion being interfittingly and slidably matingly engaged with the next longitudinally adjacent end portion of another said component, thereby to define respective component interconnection locations;

said components together comprising both a plurality of runner sections each of whose opposite end portions defines a receiving cavity, and also a plurality of base sections each of whose opposite end portions defines a projecting extension for slidable engagement with one of said receiving cavities;

said base sections having exterior configurations which adapt individual ones of said base sections for particular functional purposes at particular locations along said frame structure, said exterior configurations including:

corner members for interconnecting successive runner sections;

joining members for interconnecting successive runner sections, and connection members for interconnecting successive runner sections and for connecting said frame structure to selected components that are coactive with said section.

16. The section of claim 15 wherein at each of said component interconnection locations adjacent ones of said components are fastened together with fastening means.

17. The section of claim 15 wherein said fastening means comprises an adhesive.

18. The section of claim 15 wherein said components are comprised of plastic.

19. The section of claim 15 wherein said components are comprised of metal.

20. The section of claim 15 wherein said components are comprised of metal and plastic.

21. The section of claim 15 wherein at least one of said connection members includes means for pivotably connecting an adjacent element therewith.

22. The section of claim 15 wherein at least one of said connection members comprises a leaf of a hinge.

* * * * *